US009597716B2

(12) United States Patent
Fuchigami et al.

(10) Patent No.: US 9,597,716 B2
(45) Date of Patent: Mar. 21, 2017

(54) DRY-TYPE CLEANING CHASSIS, DRY-TYPE CLEANING DEVICE, AND DRY-TYPE CLEANING SYSTEM

(75) Inventors: Akihiro Fuchigami, Kanagawa (JP); Yoichi Okamoto, Kanagawa (JP); Kohji Tsukahara, Kanagawa (JP); Shozo Murata, Kanagawa (JP); Yusuke Taneda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 650 days.

(21) Appl. No.: 13/977,774

(22) PCT Filed: Feb. 15, 2012

(86) PCT No.: PCT/JP2012/054334

§ 371 (c)(1),
(2), (4) Date: Jul. 1, 2013

(87) PCT Pub. No.: WO2012/115174

PCT Pub. Date: Aug. 30, 2012

(65) Prior Publication Data

US 2013/0326840 A1 Dec. 12, 2013

(30) Foreign Application Priority Data

Feb. 25, 2011 (JP) ..... 2011-040605
Oct. 13, 2011 (JP) ..... 2011-226127

(51) Int. Cl.
*B24C 3/06* (2006.01)
*B08B 7/02* (2006.01)

(52) U.S. Cl.
CPC . *B08B 7/02* (2013.01); *B24C 3/06* (2013.01)

(58) Field of Classification Search
CPC ..... B24C 3/06; B08B 7/02
(Continued)

(56) References Cited

U.S. PATENT DOCUMENTS 5,975,985 A 11/1999 Sutherland et al.
7,730,896 B2 6/2010 Okamoto et al.
(Continued)

FOREIGN PATENT DOCUMENTS

EP 1754572 A1 2/2007
JP 60-188123 9/1985
(Continued)

OTHER PUBLICATIONS

European search report dated Dec. 8, 2016 in corresponding European Patent Application No. 12750267.2.

*Primary Examiner* — David Redding
(74) *Attorney, Agent, or Firm* — Cooper & Dunham LLP

(57) ABSTRACT

A dry-type cleaning chassis for cleaning a cleaning target by colliding the cleaning media with the cleaning target, the cleaning media being blown by an air flow includes an internal space where the cleaning media are to fly; an opening part being in contact with the cleaning target so that the cleaning media collide with the cleaning target; an air inlet duct introducing external air into the internal space; a suction port generating a first air flow caused by a circulating air flow in the internal space by suctioning the introduced external air; an injection port generating at least a second air flow increasing a speed of the cleaning media flown by the circulating air flow; and a porous unit passing objects removed from the cleaning target to a suction port side.

13 Claims, 20 Drawing Sheets

(58) Field of Classification Search
USPC ..... 451/92
See application file for complete search history.

(56) References Cited

U.S. PATENT DOCUMENTS

| | | | |
|---|---|---|---|
| 7,743,776 | B2 | 6/2010 | Okamoto et al. |
| 7,758,700 | B2 | 7/2010 | Fuchigami et al. |
| 7,854,648 | B2 | 12/2010 | Satoh et al. |
| 7,865,997 | B2 | 1/2011 | Fuchigami et al. |
| 2007/0283980 | A1 | 12/2007 | Okamoto et al. |
| 2009/0314312 | A1 | 12/2009 | Fuchigami et al. |
| 2010/0307535 | A1 | 12/2010 | Fuchigami et al. |
| 2011/0067731 | A1 | 3/2011 | Satoh et al. |
| 2013/0118525 | A1 | 5/2013 | Fuchigami et al. |

FOREIGN PATENT DOCUMENTS

| | | |
|---|---|---|
| JP | 04-083567 | 3/1992 |
| JP | 07-088446 | 4/1995 |
| JP | 2007-029945 | 2/2007 |
| JP | 2009-028651 | 2/2009 |
| JP | 2010-069368 | 4/2010 |
| JP | 4486468 | 6/2010 |
| JP | 2010-167419 | 8/2010 |
| JP | 2010-279947 | 12/2010 |
| JP | 2012-050973 | 3/2012 |

DRY-TYPE CLEANING CHASSIS, DRY-TYPE CLEANING DEVICE, AND DRY-TYPE CLEANING SYSTEM

TECHNICAL FIELD

The present invention generally relates to a dry-type cleaning device for cleaning by flying cleaning media and contacting or colliding the cleaning media with cleaning targets. More particularly, the present invention relates to a dry-type cleaning device that cleans the cleaning targets by contacting the cleaning media with any part of the cleaning targets, a dry-type cleaning chassis used in the dry-type cleaning device, and a dry-type cleaning system using the dry-type cleaning device.

BACKGROUND ART

Recently, fixtures for masking the regions other than the regions where soldering is to be performed have been widely used in the soldering process using a flow solder bath. Those masking fixtures (a.k.a. the dip pallet and the carrier pallet), however, are required to be periodically cleaned so as to avoid the degradation of the masking accuracy which may be degraded by the flux accumulated on the surface of the masking fixtures.

Typically, such cleaning may be performed by dipping the fixture into a solvent. Therefore, a larger amount of solvent may be required to be used. As a result, the cost may be increased and the operator's workload may be heavy.

There is a known technique to spray the solvent onto the cleaning objects without dipping. This method, however, may not overcome the problem that a larger amount of solvent is required.

To overcome the problem, there has been known a dry-type cleaning device that cleans the cleaning targets by contacting flying cleaning media with the cleaning targets. Patent Documents 1 and 2 disclose a cleaning method for cleaning the cleaning targets by flying the cleaning media in the circumferential direction in a cylindrical container (chassis) by the circulating air flow of compressed air and colliding the flying cleaning media with the cleaning targets disposed at the opening formed on the side surface of the cylindrical container.

In this method, however, the circulating air flow is caused by the compressed air. Therefore, when the cleaning targets are separated from the opening of the container (i.e. cleaning device), some of the cleaning media may leak through (be excluded from) the opening.

To overcome this problem, in Patent Document 1, a net member is provided at the opening to prevent the leakage of the cleaning media. However, due to the net member, the energy of the cleaning media when the cleaning media collide with the cleaning targets may be reduced. Further, the cleaning media may be stopped by the net member. As a result, the cleaning performance may be reduced.

Further, in Patent Document 2, a cap member that may cap (seal) the opening is provided to prevent the leakage of the cleaning media through the opening. This cap member, however, may force an operator to promptly operate the cap member upon separating the cleaning targets from the opening. As a result, extra workload and attention may become necessary, the device may have to have a complicated mechanism, the operation of the cleaning device may become much more difficult, and the cleaning device may be more likely to be broken.

To overcome at least one of the problems in the dry-type fixing device of the related art, the Applicant of the present invention has filed an invention of a dry-type cleaning device under Japanese Patent Application No. 2010-175667. In the dry-type cleaning device, suctioning unit is provided to be connected to a chassis of the dry-type cleaning device, so that when an opening of the chassis disposed at the cleaning targets, slice-like cleaning media are flown by a circulating air flow generated by air flowing from the outside of the chassis into the chassis through an air path of the suctioning unit and the cleaning media remain within the chassis by providing, for example, a net-like porous unit that passes air and dust in the chassis but does not pass the cleaning media, so that the circulated flying of the cleaning media can be continued by the circulating air flow.

According to the dry-type cleaning device, when the opening of the chassis is separated from the cleaning targets, the circulating air flow may disappear because the internal pressure at the opening becomes substantially equal to the atmospheric pressure, and due to the negative pressure caused by suctioning air, much air is introduced into the chassis through the opening. As a result, the cleaning media remain in the chassis by being adsorbed on the porous unit and do not leak from the opening.

DISCLOSURE OF THE INVENTION

Problems to be Solved by the Invention

According to the prior invention of the applicant of the present invention, as schematically illustrated in FIGS. 16A and 16B, the suctioning unit 6 is used to suction air in the chassis 4, the opening part 18 is in contact with the cleaning target 20 to close the opening part 18, a negative pressure is generated in the chassis 4, so that external air flows into the chassis at high speed to generate a circulating aerial flow 30 to fly the cleaning media 5, so that the cleaning media 5 can collide with the surface to be cleaned of the cleaning targets 20 to perform cleaning. In this case, the cross-section of the path of the circulating aerial flow 30 is limited by the path limiting member 16.

Before the opening part 18 is closed (sealed), the cleaning media 5 are adsorbed on the separation plate 14 as the porous unit by the suctioning operation of the suctioning unit 6 so as to remain in the chassis 4.

According to this configuration, an operator may hold the device and move the chassis 4 easily. Further, the operator may easily place the opening part 18 at a pinpoint of the desired part of the cleaning target 20 to clean the cleaning target 20. Therefore, the degree of freedom may become higher.

On the other hand, a paper seal on which, for example, a note of caution is written may be adhered to a part (i.e., the cleaning target). Generally, such a paper seal may be tightly adhered to the part using an adhesive material having viscous elasticity (viscoelasticity). When such a paper seal is adhered to the part, it may be very difficult to remove the paper seal from the cleaning target in a recycle cleaning process with a conventional cleaning device including the cleaning device according to the prior application of the applicant of the present invention regardless of the suction method and the compression method.

This is because the mass of a single foil-like cleaning medium is low, and even when the cleaning medium is fastly flying (blown) by a circulating air flow, the kinetic energy of the cleaning medium is still relatively low. Therefore, when a stain to be removed has enough viscoelasticity to adhere to the cleaning target, the stain may be deformed by absorbing the kinetic energy, which makes it more difficult to be chipped and removed.

To resolve this problem, it may be necessary to crease a flying speed of the cleaning medium, in other words, to increase the collision speed of the cleaning medium relative to the cleaning target.

This is because the stain to be removed may be more likely to absorb the force by deforming itself when the force is applied to the stain at a lower speed. When the cleaning medium flying at a higher speed collides with the stain, the deformation amount of the stain may be smaller so that the stain may behave more like a solid substance. As a result, the stain may not be deformed and destroyed by absorbing the kinetic energy of the cleaning medium. This characteristics may also be observed when, for example, a high-pressure water (water jet) is directed to a solid, the solid may be cut (destroyed).

However, in a conventional dry-type cleaning device, it may be difficult to allow the cleaning medium to have sufficient (flying) speed so as to remove the adhesive material (a stain having viscoelasticity).

To increase a flow rate, may be general to reduce (squeeze) the cross-sectional area of the (air) flow path of an inlet. When the cross-sectional area of the flow path is reduced, however, a flow path resistance may be increased. As a result, the flow rate at the inlet may be reduced, and accordingly, the flow rate in the chassis may also be reduced. Therefore, it may become difficult to fly a sufficient amount of cleaning media and reduce the cleaning performance.

The above case may be applied to the prior application of the applicant of the present invention. However, a similar difficulty may also occur in the compression method.

Namely, when a high-pressure compression air supply source is connected to the input port of the inlet to increase the air pressure at the inlet, the air flow speed provided from the inlet is increased in proportion to the square root of the differential pressure between the pressure of the input port of the inlet and the output port of the inlet. Therefore, the flow speed of the air flow blowing from the inlet may be increased and fast circulating air flow may be generated. However, practically, due to occurrence of the air compression, the speed of the blowing air flow never exceeds the acoustic velocity.

However, when a high pressure is applied, a large amount of flow rate may be consumed. Therefore, to maintain the differential pressure to generate the fast air flow, it may become necessary to provide a compression air supply source having a huge tank capacity, which may be impractical.

The present invention is made in light of the above circumstances, and may provide a dry-type cleaning chassis that removes not only a stain such as flux but also a stain having viscoelasticity so as to increase a range of the cleaning targets and improve the commodity value, and a dry-type cleaning device including the dry-type cleaning chassis.

Means for Solving the Problems

As described above, to remove the stain having viscoelasticity, it may be necessary to simultaneous secure (obtain) a sufficient flow rate to increase the number of collisions per unit time while maintaining the amount of the cleaning media reaching an opening part per unit area and sufficient flow speed to remove the stain having viscoelasticity. However, there is a trade-off relationship between the flow rate and the flow speed. Therefore, when, for example, main attention is paid to secure sufficient flow rate, as described in the above experiment based on the technique of the prior application, the difficulty of removing the stain having the viscoelasticity may not be overcome.

As described below, according to an embodiment of the present invention, the suction method is employed in the fundamental configuration. The suction method may have some intrinsic advantages that the scattering of the cleaning media is negligible (almost none) and the energy loss is smaller when compared with the compressing method. Further, in an embodiment, two types of air flows having different flow rate and flow speed from each other are used, so that each of the air flows has the specific function of the flow rate of the flow speed. As a result, a (sufficient) flow speed that may remove the stain having viscoelasticity is obtained.

Namely, in the embodiment, the cleaning media may fly at a sufficient flying speed to remove the stain having viscoelasticity. To that end, the flying speed of the cleaning media is increased by injecting and combining an air flow (second flow) to another air flow (first flow), the first air flow being for securing the flow rate, the second flow being different from the first flow.

According to an aspect of the invention, a dry-type cleaning chassis for cleaning a cleaning target by colliding the cleaning media with the cleaning target, the cleaning media being blown by an air flow includes an internal space where the cleaning media are to fly; an opening part being in contact with the cleaning target so that the cleaning media collide with the cleaning target; an air inlet duct introducing external air into the internal space; a suction port generating a first air flow caused by a circulating air flow in the internal space by suctioning the introduced external air; an injection port generating at least a second air flow increasing a speed of the cleaning media flown by the circulating air flow; and a porous unit passing objects removed from the cleaning target to a suction port side.

According to another aspect of the present invention, a dry-type cleaning device includes the dry-type cleaning chassis according to an aspect of the present invention; a suctioning unit connected to the suction port; an injection air supply source connected to the injection port; and the cleaning media.

According to another aspect of the present invention, a dry-type cleaning system includes the dry-type cleaning device according to an aspect of the present invention; a holding unit holding the cleaning target so as to be cleaned; and a cleaning region changing unit causing at least one of the dry-type cleaning device and the holding unit to more to change a cleaning region of the cleaning target.

The definitions of the terms used in this description are described.

The term "chassis" used herein refers to a container-like structure having a space where a circulating air flow is likely to be generated in the structure. The term "space where a circulating air flow is likely to be generated" refers to a space having a shape including a continuous inner surface so that air may circulate along the inner surface of the space. More preferably, the space has a shape including a rotating-body-shaped inner surface or inner space.

The term "air flow path" used herein refers to a unit that allows air to flow in a certain direction and typically has a tube shape and a smooth inner surface. Further, the "air flow path" may also refer to a path formed by using a plate-like path limiting plate having a smooth surface when air can flow along the surface and air flowing direction is determined.

In addition to a general case where air flows linearly, in a case where air flows in a gentle curve having a low flow path resistance, a certain air flowing direction may also be determined. However, unless otherwise described, the term "direction of the air flow path" refers to the direction of air flow blowing out at an air flow inlet. Further, herein, the air flow path having a straight tube shape, having one end connected to the air flow inlet, and having another end as an air taking inlet open to the atmosphere of the outside of the chassis may refer to an "inlet". Generally, the inlet includes a smooth inner surface having a low fluid resistance and has a circular, rectangular, or slit-shaped shape to be cross section.

Further, herein, the term "circulating air flow" refers to a flow accelerated at the position of the air flow inlet by an incoming flow and flowing by changing the flowing direction along the inner surface of the chassis, returning to the position of the air flow inlet, and joining with the incoming flow. When the fluid forming the air flow is air, the term "circulating aerial flow" may be used as the equivalent term. Generally, the circulating air flow may be generated by flowing (introducing) air in the tangential direction of the inner wall in a closed space having continuous (endless) inner wall.

According to an embodiment of the present invention, the terms "air flow" and "aerial flow" generally refer to an air flow of air. However, it is also assumed that the terms "air flow" and "aerial flow" may also refer to a concept of an atmosphere including a charging control agent.

Effects of the Present Invention

According to an embodiment, it may become possible to remove not only a stain such as flux but also a stain having viscoelasticity so as to increase a range of the cleaning targets, improve the commodity value, and greatly contribute to a cleaning and recycle process.

DESCRIPTION OF THE REFERENCE NUMERALS

5: CLEANING MEDIUM
6: SUCTIONING UNIT
8: SUCTION PORT
14: SEPARATION PLATE
16: FLOW PATH LIMITING MEMBER
18: OPENING PART
20: CLEANING TARGET
24: INLET
24B,64: AIR FLOW INJECTION PORT
54: COMPRESSION AIR SUPPLY SOURCE
56: VALVE AS INJECTION AIR FLOW RATE ADJUSTMENT UNIT
62: ATTACHMENT
68: CONTACT SENSOR AS SWITCH
72: CONTROLLER
AR1: FIRST AIR FLOW
AR2: SECOND AIR FLOW

BEST MODE FOR CARRYING OUT THE INVENTION

In the following, embodiments of the present invention are described with reference to the accompanying drawings.

First, with reference to FIGS. 16A through 18, a configuration and operations of a dry-type cleaning device according to a prior invention of the applicant of the present invention is described.

Figure 16A:
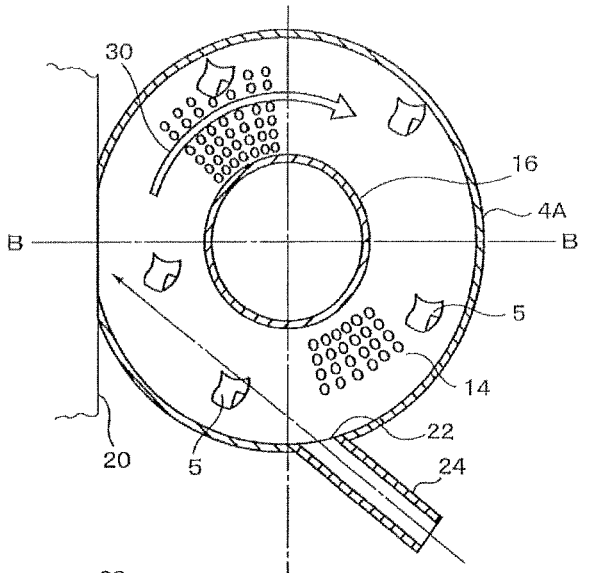
FIGS. 16A and 16B are schematic cross-sectional views of a dry-type cleaning device which is a base of the dry-type cleaning device according to embodiments of the present invention.
Figure 16B:
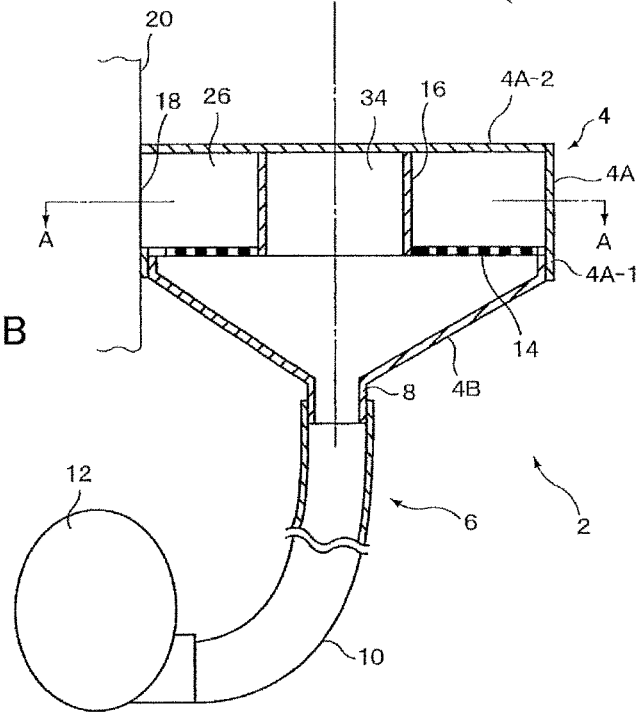

Further, with reference to FIGS. 16A and 16B, an example configuration of a portable-type dry-type cleaning device 2 according to an embodiment of the present invention is briefly described. FIGS. 16A and 16B are vertical cross-sectional views when cut along A-A line and B-B line of FIGS. 16B and 16A, respectively.

As illustrated in FIGS. 16A and 16B, the dry-type cleaning device 2 includes a dry-type cleaning chassis (hereinafter may be simplified as a "chassis") 4 having a flying space (space) of cleaning media 5 in the chassis and a suctioning unit 6 that generates a negative pressure in the chassis 4. The chassis 4 includes an upper chassis 4A having a cylindrical shape and a lower chassis 4B having an inverted conical shape. The upper chassis 4A and the lower chassis 4B are integrated with each other to constitute the chassis 4.

Herein, the terms "upper" and "lower" are used for explanatory purposes in the figures. Therefore, for example, in actual use, the device may not be used based on the terms "upper" and "lower".

As illustrated in FIG. 16A, a suction port 8 is integrally connected to the top of the conical shape of the lower chassis 4B so as to function as a suction duct. As illustrated in FIG. 16B, a suctioning unit 6 includes a suction hose 10 and a suction device 12. One end of the suction hose 10 is connected to the suction port 8, and the other end of the suction hose 10 is connected to the suction device 12. As the suction device 12, a vacuum cleaner for domestic use, a vacuum motor, a vacuum pump, or a device indirectly generating a low pressure or a negative pressure by pumping liquid (liquid transfer pressure) may be used. Herein, the terms "upper surface", "bottom surface" and the like are used for illustration purposes only.

Referring back to FIG. 16B, the upper chassis 4A includes an engage concave part 4A-1 at the bottom surface part of the upper chassis 4A. The engage concave part 4A-1 is detachably engaged with the upper end part of the lower chassis 4B. The upper surface 4A-2 of the upper chassis 4A is sealed.

In a boundary area between the upper chassis 4A and the lower chassis 4B at the bottom surface part of the upper chassis 4A, a porous separation plate 14 is provided as a porous unit. The separation plate 14 is a plate member having holes of a punched metal. In FIG. 16A, the display of some parts of the separation plate 14 is omitted. Further, the size of the cleaning media 5 is increased for explanatory purposes.

As the porous unit, any appropriate porous matter (member) may be used as long as the matter does not pass the cleaning media 5 and passes air and dirt (i.e., matter removed from the cleaning targets). For example, a slit plate, a net or the like may be used. Further, as material of the porous unit, any appropriate material may be used as long as the material has smooth surfaces. For example, resin, a metal or the like may be used.

The porous unit is disposed so that the surface of the porous unit is substantially orthogonal to the central axis of the circulating air flow. By doing this, air flows along the surface of the porous unit, which may prevent the stagnation of the cleaning media 5 at the porous unit.

To reduce the attenuation of the circulating air flow and the stagnation of the cleaning media 5, it may be preferable that the inner surface in the chassis is flat and smooth without unevenness.

The cleaning media 5 adsorbed on the surface of the porous unit may be flown again by disposing the porous unit along the surface substantially parallel to the direction of the circulating air flow.

The material of the chassis 4 is not limited to a specific material. It may be preferable that a metal such as aluminum, stainless or the like is used to reduce the adhesion of foreign matter and the dissipation by friction with the cleaning media. Further, a material made of resin may also be used.

In the center part in the upper chassis 4A, a flow path limiting member 16 having a cylindrical shape is provided as a part of the chassis 4. The flow path limiting member 16 has the same cylindrical axis as that of the upper chassis 4A. Further, the lower end of the flow path limiting member 16 is fixed to the separation plate 14.

The flow path limiting member 16 is provided for squeezing (reducing) the flow cross-sectional area of the circulating air flow so as to in improve the flow speed of the circulating air flow. Namely, by having the flow path limiting member 16, a ring-shaped space that allows the circulating air flow to flow (move) in the space (circulating aerial moving space) is formed. In other words, a space where the cleaning media is flown (i.e., flying space of the cleaning media) is formed.

It should be noted that it is not always necessary that the central axis (cylindrical axis) of the flow path limiting member 16 be the same as that of the upper chassis 4A. Namely, the central axis (cylindrical axis) of the flow path limiting member 16 may be different from that of the upper chassis 4A as long as such a ring-shaped space is formed.

Further, at one part of the side surface of the upper chassis 4A, an opening part 18 is formed. The opening part 18 is provided so that the cleaning media 5 flown by the circulating air flow may be in contact with or collide with the cleaning target through the opening of the opening part 18.

As described above, basically, the upper chassis 4A has a cylindrical shape. However, by forming the opening part 18, the upper chassis 4A comes to have a shape as illustrated in, for example, FIG. 16B. Namely, the upper chassis 4A has a shape so that the outer circumferential part other than the opening part 18 may largely escape (be separated) from the cleaning target 20. As a result, it may become possible to improve the degree of freedom of local contact with the cleaning target 20 (i.e., pinpoint cleaning).

The opening part 18 has a shape formed by cutting the side surface of the upper chassis 4A by a flat cross-sectional surface parallel to the cylindrical axis of the upper chassis 4A. Therefore, when viewed from the direction orthogonal to the cylindrical axis, the shape of the opening part 18 is rectangular.

Further, at another part of the side surface of the upper chassis 4A, an air intake port 22 is formed. Further, an inlet (i.e., air inlet duct) 24 as a circulating air flow generation unit and as a ventilation path is externally connected to the upper chassis 4A in a manner such that external air may be introduced in the upper chassis 4A through the inlet 24 and the air intake port 22.

Further, the central axis (i.e., the ventilation (air flow) direction) of the inlet 24 is set so as to be substantially parallel to the separation plate 14. The ventilation direction of the inlet 24 is inclined relative to the radial direction of the upper chassis 4A, so that when the central axis of the inlet 24 is extended, the extended central axis of the inlet 24 reaches the opening part 16.

Figure 2:
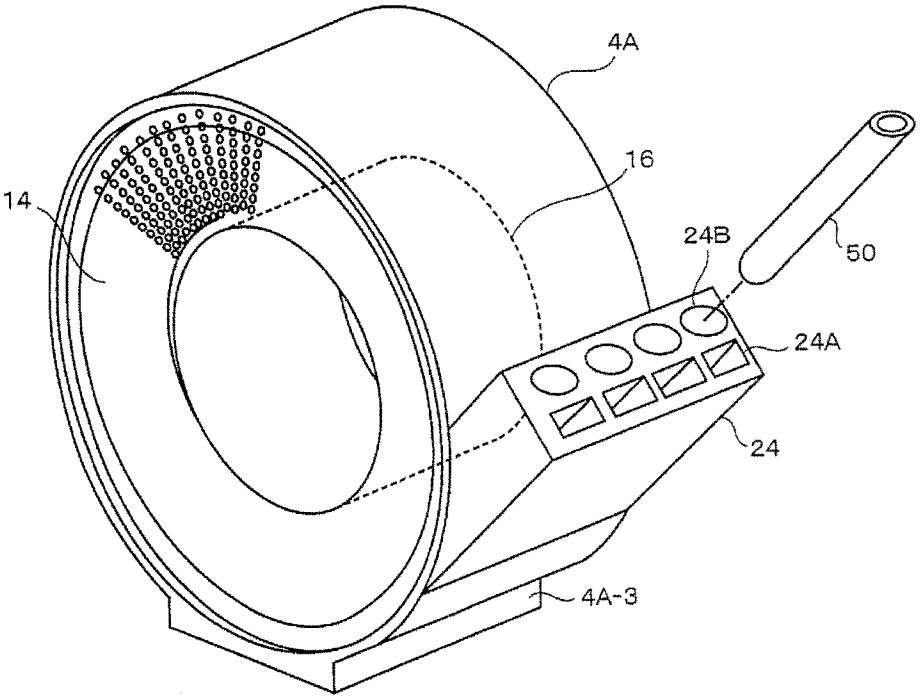
FIG. 2 is a perspective view of the dry-type cleaning chassis.

The inlet 24 has a width extending in the height direction of the upper chassis 4A. Only one inlet 24 having the diameter or width less than the height of the upper chassis 4A may be provided. Alternatively, as illustrated in FIG. 2, plural units of the inlet 24 may be arranged in the height direction of the upper chassis 4A.

As suggested in FIGS. 16A and 16B, when the opening part 18 is in contact with the cleaning target 20 and sealed, a closed space is generated in the chassis 4 and external air is introduced at a fast speed, so that the introduced fast air flow accelerates the cleaning media 5 toward the opening part 16 and generates a circulating aerial flow 30 as a circulating air flow.

The circulating aerial 30 generated when the closed space is generated blows up the cleaning media 5 adsorbed on the separation plate 14 (again).

Further, the size of the opening part 18 is large enough so that, when the opening part 18 is released (i.e., when the opening part 18 is separated from the cleaning target 20), the internal pressure at the opening part 18 becomes substantially equal to atmospheric pressure. Similarly, the opening part 18 is disposed at a position where when the opening part 18 is released, thy internal pressure at the opening is more likely to equal a pressure value substantially equal to the atmospheric pressure.

By having the configuration as described above, while the dry-type cleaning device 2 is not in contact with the cleaning target 20, the internal pressure at the opening part 18 becomes substantially equal to atmospheric pressure so that the differential pressure between the internal pressure and the external pressure is reduced. As a result, the amount of air flowing into the upper chassis 4A through the opening of the opening part 16 is remarkably reduced. On the other hand, the amount of air flowing into the upper chassis 4A is increased. As a result, it may become possible to prevent the leakage of the cleaning media 5 from the chassis 4.

Further, the amount of air flow while the opening part 18 is released may become two times or three times greater than the amount of air flow while the opening part 18 is sealed. Therefore, while the opening part 18 is released, the slice-shaped cleaning media 5 are adsorbed on the porous unit (separation plate 14) and do not fly to be leaked from the chassis 4. This effect may be called a cleaning media adsorption effect while the opening part 18 is released.

The cleaning media 5 herein refer to an assembly of sliced cleaning piece. Further, herein, the cleaning medium 5 refers to a unit of the sliced cleaning pieces.

The sliced cleaning medium 5 herein refers to a slice of material having an area equal to or less than 100 $mm^2$. The material of the cleaning medium 5 may be a film having durability such as polycarbonate, polyethylene terephthalate (PET), acryl, cellulose resin and the like. The thickness of the cleaning medium may be in a range from 0.02 mm to 0.2 mm.

However, depending on the cleaning target 20, it may be effective when the thickness, the size, or the material of the cleaning media is changed. Namely, any of the various kinds of the cleaning medium may be used in the present invention.

Therefore, it should be noted that the limitations described above for the cleaning media are examples only, and the cleaning medium used in embodiments of the present invention is not limited to the cleaning medium described above.

Further, the material of the cleaning medium is not limited to resin. Namely any appropriate material having a slice shape and light weight so as to be easily blown such as a slice of paper, cloth, mica, mineral, ceramics, glass, a metallic foil or the like may be used.

Herein, an internal space 26 (FIG. 16B) has a ring shape in the upper chassis 4A, so that the cleaning media 5 in the internal space 26 may be blown by the rotating air flow and be in contact with or collide with the cleaning target 20 facing the opening part 18. On the other hand, in an internal space 34 (FIG. 16B) formed by the flow path limiting member 16 and the like, there is no circulating air flow.

Figure 17B:
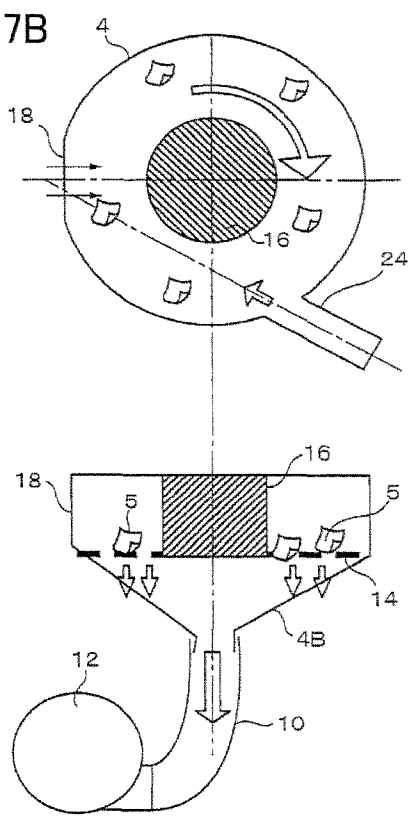
FIGS. 17A and 17B are drawings illustrating a cleaning operation of the dry-type cleaning device.
Figure 17A:
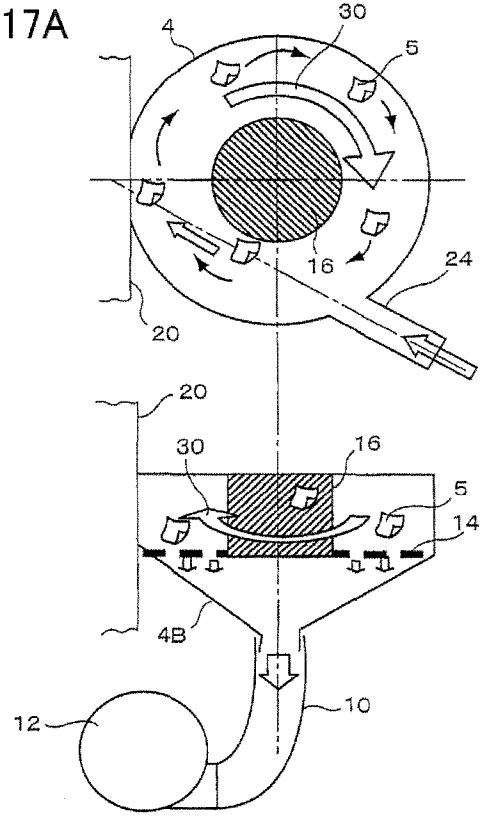

Next, a cleaning operation performed by the dry-type cleaning device 2 having the above configuration is described with reference to FIGS. 17A and 17B. In FIGS. 17A and 17B, the thickness of the elements and the like are not accurately depicted and the hatching as displayed in the internal space 34 as a quiet space so as to be understood easily.

FIG. 17B illustrates a case where the opening part 18 is separated from the cleaning targets 20 so that air is suctioned while the opening part 18 is released. On the other hand, FIG. 17A illustrates a case where the opening part 18 is disposed at the position of (in contact with) the cleaning targets 20 and sealed.

Before starting the cleaning operation, the cleaning media 5 are provided (supplied) into the chassis 4. The cleaning media 5 having been supplied into the chassis 4 are adsorbed on the separation plate 14 as illustrated in FIG. 170 and stored in the chassis 4.

In the case, due to the suctioning operation by the suctioning unit 6, a negative pressure is generated in the chassis 4. Therefore, air outside the chassis 4 may flow into the chassis 4 through the inlet 24. However, in this case, the flow speed and the flow rate of the air flow in the inlet 24 are small. As a result, the circulating aerial flow 30 generated in the chassis 4 may not become strong (sufficient) enough to blow up the cleaning media 5 having been adsorbed on the separation plate 14.

When the cleaning media 5 are supplied and stored in the chassis 4, as illustrated in FIG. 17A, the opening part 18 is in contact with the area to be cleaned on the surface of the cleaning target 20, so as to form a sealed state.

When the opening part 18 is sealed, air suctioning flow through the opening of the opening part 18 is stopped. As a result, the negative pressure in the chassis 4 is rapidly increased, and both the amount and the flow rate of air suctioned through the inlet 24 are increased. Then, the air flow defined by the inlet 24 flows out from the output port of the inlet (i.e., the air intake port 22) into the chassis as a high-speed air flow (hereinafter may be referred to as a "first air flow").

Due to the air flowing out from the air intake port 22, the cleaning media 5 stored on the separation plate 14 are blown up and fly to the surface of the cleaning target 20 facing the opening part 18.

The air flow becomes the circulating aerial flow 30 flowing along the inner wall of the chassis to form a ring-like air flow. However, some parts of the air flow passes through the holes of the separation plate 14 due to being suctioned by the suctioning unit 6.

When the circulating aerial flow 30 flowing in the chassis 4 in a ring shape described above is returned to the position near the air intake port 22 of the inlet 24, the circulating aerial flow 30 is combined with and accelerated by the air flow from the inlet 24. As described above, the stable circulating aerial flow 30 may be formed in the chassis 4.

The cleaning media 5 are circulated in the chassis 4 by the circulating aerial flow 30, so that the cleaning media 5 may repeatedly collide with the surface of the cleaning target 20. Due to the impact by the collision, stains on the surface of the cleaning target 20 are separated from the surface in the form of fine particles or powder.

The separated stain particles are discharged outside of the chassis 4 by passing through the holes of the separation plate 14 by the suctioning unit 6.

The rotational axis of the circulating aerial flow 30 formed in the chassis 4 is orthogonal to the surface of the separation plate 14. Therefore, the circulated air flow 30 is flowing in the direction substantially parallel to the surface of the separation plate 14.

Therefore, the circulating aerial flow 30 blows the cleaning media 5 adsorbed on the separation plate 14 in the lateral direction and flows between the cleaning media 5 and the separation plate 14, so as to pull up the cleaning media 5 from the separation plate 14 to blow up the cleaning media 5 again.

Further, when the opening part 18 is sealed, the negative pressure in the upper chassis 4A is increased to be close to the negative pressure in the lower chassis 4B. Therefore, the force adsorbing the cleaning media 5 to the surface of the separation plate 14 may be reduced, which may make it easier for the cleaning media 5 to fly again.

The circulating aerial flow 30 is likely to become a fast air flow because of being accelerated in a steady direction, which may also assist the fast flying movement of the cleaning media 5 in the chassis 4. While the cleaning media 5 are flying in the fast air flow rotating at high speed, the cleaning media 5 are unlikely to be adsorbed on the separation plate 14 and the stain particles attached to the cleaning media 5 are likely to be separated from the cleaning media 5 due to the centrifugal force applied to the stain particles.

Figure 18:
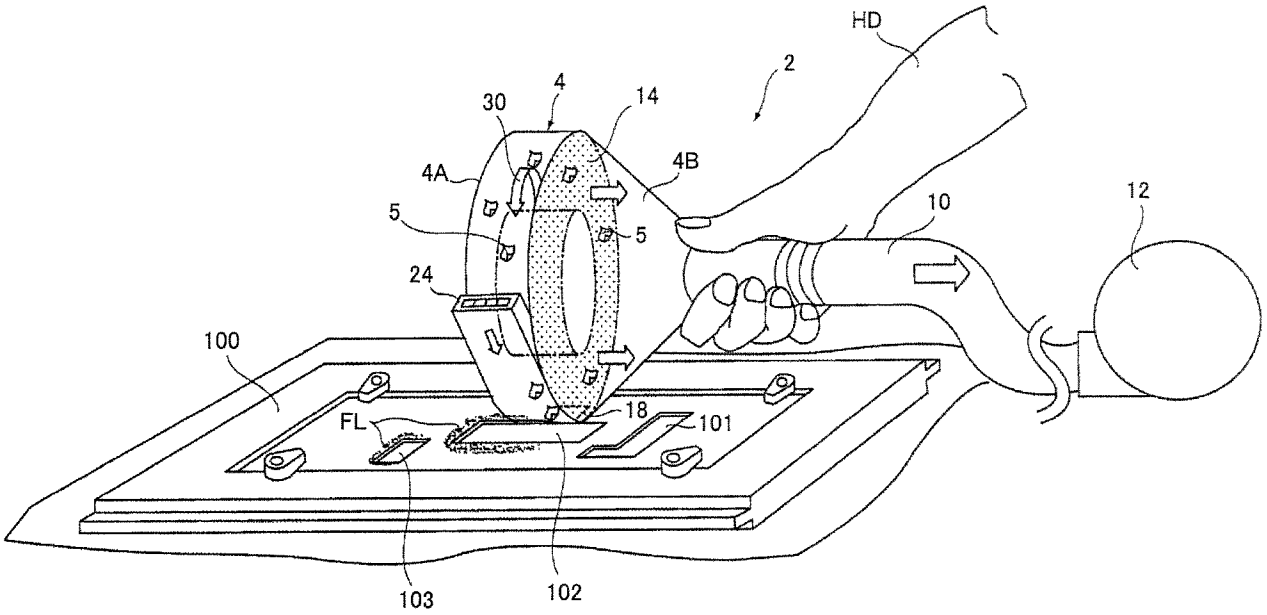
FIG. 18 illustrates an example of how the dry-type cleaning device is used.

FIG. 18 illustrates a case where the dry-type cleaning device 2 described above is used. In this example, the dry-type cleaning device 2 removes the stains near the mask opening parts 101 through 103 of the dip pallet 100 used in a process using the flow solder bath. Flux to be removed is accumulated and adhered near the holes of the mask opening parts 101, 102, and 103.

In this case, as illustrated in FIG. 18, the base portion near the suction port 8 of the lower chassis 4B is held by a hand HD. Then, while air is suctioned by the suction device 12, the opening part 18 of the chassis 4 is pressed to the portion to be cleaned.

Before the opening part 18 is pressed to the portion to be cleaned, air in the chassis 4 is suctioned and the cleaning media 5 are adsorbed on the separation plate 14. Therefore, even though the opening part 18 direction is downward, the cleaning media 5 are prevented from being leaked (excluded) from the chassis 4.

Also, after the opening part 18 is pressed to the portion to be cleaned, the sealed state of the chassis is formed. Therefore, no cleaning media 5 may be leaked from the opening of the opening part 18.

When the opening part 18 is pressed to the portion to be cleaned, an amount of air flowing through the inlet 24 is remarkably increased. As a result, the strong circulating aerial flow 30 is generated in the chassis 4 and blows up the cleaning media 5 adsorbed on the separation plate 14, so that the cleaning media 5 can collide with the flux FL adhered and fixed to the portion to be cleaned to remove the flux FL.

A cleaning operator may hold the base portion near the suction port 8 and move the position of the cleaning device 2 relative to the dip pallet 100 so as to sequentially move the cleaning device 2 on the portions to be cleaned to remove all the flux FL adhered and fixed to the portions to be cleaned.

In the state of FIG. 18, the peripheral area of the mask opening part 101 of the dip pallet 100 has been cleaned, and the peripheral areas of the mask opening parts 102 and 103 have not been cleaned yet.

In the cleaning operation, even when the opening part 18 is separated from the portions to be cleaned while the opening part 18 is moved relative to the portions to be cleaned, the cleaning media 5 are unlikely to be leaked from the chassis 4 as described above. As a result, the number (amount) of the cleaning media 5 is maintained or hardly reduced, thereby enabling substantially maintaining the cleaning performance.

The cleaning media 5, however, may be gradually damaged by, for example, the repeated collisions with the cleaning target 20. In this case, the damaged cleaning media 5 along with the flux (i.e. stains) removed from the cleaning target 20 (e.g., the dip pallet 100) may be collected by the suction device 12. Therefore, the number (amount) of the cleaning media 5 stored in the chassis 4 may be gradually reduced.

In such a case, additional cleaning media 5 may be supplied into the chassis 4.

Next, features (not shown in FIGS. 16A through 18) according to first embodiment of the present invention are described with reference to FIGS. 1 though 3. Hereinafter (throughout the descriptions of embodiments), the same reference numerals are used to describe the same elements, and repeated descriptions thereof may be omitted.

As illustrated in FIG. 2, in this embodiment, the inlet 24 as the suction port includes plural inlet openings 24A (hereinafter may be simplified as an "inlet opening 24A" or "inlet openings 24A") and plural air flow injection ports 24B (hereinafter may be simplified as an "air flow injection port 24B" or "air flow injection ports 24B"). The plural inlet openings 24A are used as the inlets having the original function of the inlet so as to introduce the first air flow into the chassis 4. The plural air flow injection ports 24B are injection ports to inject a second air flow into the chassis 4, the second air flow having different flow rate and flow speed from those of the first air flow. The plural inlet openings 24A and the plural air flow injection ports 24B are integrally formed.

Figure 1:
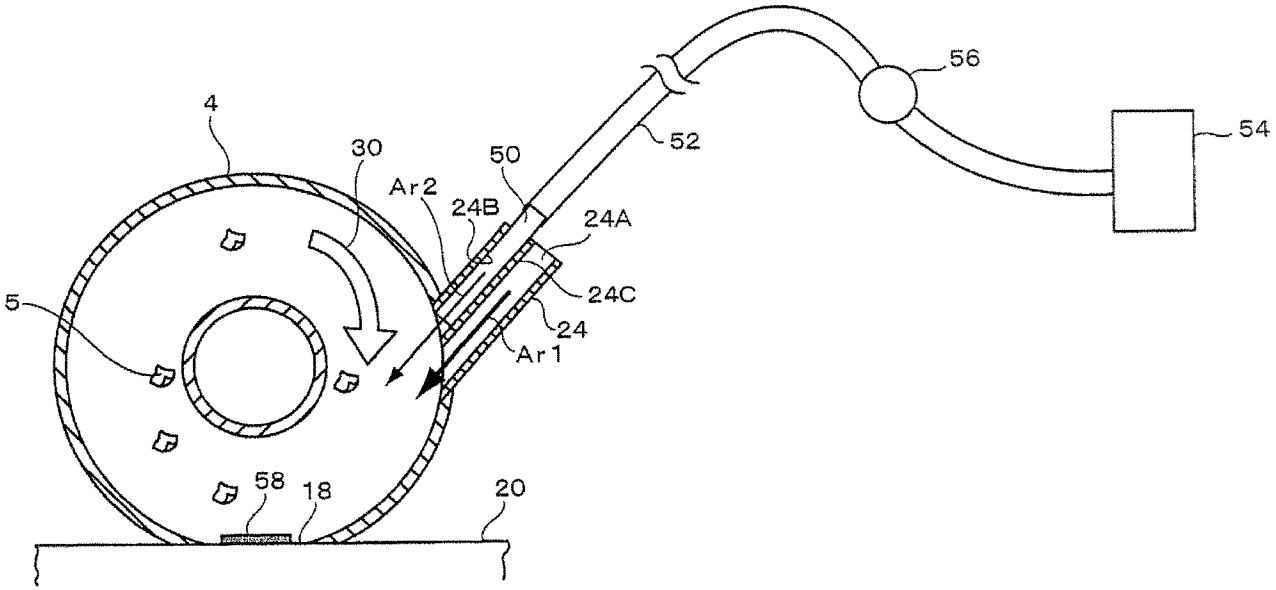
FIG. 1 is a side view of a dry-type cleaning chassis when being used according to a first embodiment.

As illustrated in FIG. 1, the inlet opening 24A and the air flow injection port 29B are separated by a dividing wall 240, and a nozzle 50 is inserted into each of the plural air flow injection ports 24B.

The nozzle 50 is connected to a compressor (compression air supply source) 54 as a compression air supply source via a flexible compression air supply tube 52. Further, a valve 56 to manually open and close is provided between the nozzle 50 and the compressor 54.

FIG. 1 illustrates a case where the air flow injection port 24B is disposed on the upstream side of the inlet opening 24A in the circulating direction of the circulating aerial flow 30. However, even when the air flow injection port 24B is disposed on the downstream side of the inlet opening 24A, a similar effect may be obtained.

The nozzle 50 has an internal diameter of 2.5 mm and an outer diameter of 4 mm. Four nozzles 50 arranged side by side are inserted into the corresponding air flow injection ports 243. The shape of the cross-sectional opening of the inlet opening 24A is a rectangular having a size of 6×4 mm. As a whole, four openings of the inlet openings 24A are arranged side by side.

Therefore, the flow path cross-sectional area of the first air flow is calculated as $24\times4=96\ mm^2$, and the flow path cross-sectional area of the second air flow is calculated as $(2.5\div2)^2\times3.14\times4=19.6\ mm^2$.

Next, an operation (usage) of this device is described.

First, the suction device 12 is driven to take the cleaning media 5 into the chassis 4, and the opening part 18 is moved to be in contact with and sealed with the cleaning target 20, so that the circulating aerial flow 30 is generated by the air flow introduced through the inlet openings 24A (i.e., the first air flow ("Ar1" in FIG. 1)). The above operation may be similar to that in the prior application.

In addition to that, in this embodiment, the valve 56 is open, so that compression air is injected toward the opening part 18.

The second air flow ("Ar2" in FIG. 1) (compression air flow) from the air flow injection port 24B is injected in a manner such that the second air flow flows in the direction substantially parallel to the flying trajectory of the cleaning media 5 to be collided with the cleaning target 20 in the opening part 18. In other words, the second air flow is injected in the direction substantially parallel to the normal direction of the circulating aerial flow 30 flowing towards the opening part 18.

Preferably, at least the supply flow rate of the second air flow Ar2 injected from the air flow injection ports 24B is equal to or less than the suction amount of the suction device 12, and the flow speed of the second air flow Ar2 is greater (faster) than the flow speed of the first air flow. By having the configuration, the slice-shaped cleaning media 5 are flown by the circulating aerial flow 30 may be accelerated by the injected compression air and collide with a stain having viscoelasticity through the opening part 18.

The flow speed of the second air flow Ar2 may contribute to the acceleration of the circulating aerial flow 30.

After the collision with the cleaning target 20, the cleaning media 5 may circulate in the chassis 4 by the circulating aerial flow 30 and repeatedly be accelerated to collide with the cleaning target 20. In the configuration in this embodiment, the second air flow Art in injected in the direction parallel to the direction of the first air flow Ar1. Therefore, the circulating aerial flow 30 may circulate faster due to the second air flow Ar2 of compression air. Namely, the circulating speed of the circulating aerial flow 30 may be increased.

As a result, with the increase of the collision speed, the number of the collisions of the cleaning media 5 may be increased, thereby greatly improving the cleaning performance.

The features of this device may be, for example, acceleration by the compression air (i.e., the second air flow Ar2) and the combination (assistance) of the circulating aerial flow 30 by the introduced air (i.e., the first air flow Ar1). The air flow using compression air may increase the flow speed by squeezing an orifice but may not sufficiently increase the flow rate. Therefore, the air flow using compression air may not be appropriate to generate a circulating aerial flow sufficient to fly (blow) the cleaning media 5.

On the other hand, the air introduced by the negative pressure in the chassis 4 has opposite characteristics. Namely, the flow speed may not be as fast as that of the compression air but greater flow rate may be acquired easily. Namely, a strong circulating aerial flow may be more likely to be generated.

Therefore, in this device, the circulating aerial flow 30 generated by the introduced air is used to fly the cleaning media 5, and the injected compression air is used to accelerate the flow speed of the cleaning media 5.

Therefore, it is assumed that the injection speed of the air by the compression air is faster than the speed of the circulating aerial flow. Herein, the term "speed of the circulating aerial flow" is defined as the average value of the flow speed in the flow path in the chassis 4, the flow path excluding the region between the inlet 24 and the opening part 18.

When the flow path in the chassis 4 has a rotational body shape, it is observed that the flow speed of the circulating aerial flow in the chassis 4 is substantially a constant value except the region, between the 24 and the opening part 18, where the air introduced through the inlet 24 and the circulating aerial flow are combined.

After the cleaning is finished, first, the valve 56 is closed to stop the supply of the compression air. Then, while the suction device 12 is driven, the opening part is separated from the cleaning target 20. The cleaning media 5 fly and are adsorbed on the separation plate 14 of the chassis 4 without being leaked or dropped from the chassis 4.

In this embodiment, a compression air flow rate (i.e., the flow rate of the second air flow Ar2) was 300 l/min, and a suction flow rate by the suction device 12 was 950 l/min. The flow rate was measured by connecting the air flow flow rate meter to the compression air supply tube 52 and the suction hose 10. Therefore, the flow rate of the air externally introduced into the chassis 4 (i.e., the flow rate of the first air flow Ar1) was 650 l/min. Based on the flow path cross-sectional areas and the flow rates, the flow speed of the air flow (the first air flow Ar1) inside the inlet openings 24A was calculated as approximately 113 m/s, and the injection speed of the compression air flow (the second air flow Ar2) near the injection output port was calculated as approx 250 m/s. After the injection, the injected air may pull surrounding air, diffuse, and generate many air turbulences. Therefore, it is difficult to theoretically calculate the flow speed at a position separated from the injection output port. However, generally, the flow speed is decreased.

Under the conditions, the cleaning media 5 were flown in the chassis 4. As a result, a material (stain) having viscoelasticity remaining on an outer chassis of an electronic copier made of resin was removed in approximately thirty seconds, the effect of the above configuration was observed.

According to a measurement using a high-speed camera, the cleaning media 5 collided with the cleaning target 20 at a speed in a range from 20 m/s to 25 m/s when no compression air is supplied. On the other hand, it was observed that the cleaning media 5 collided with the cleaning target 20 at a speed in a range from 60 m/s to 75 m/s when compression air (i.e., the second air flow Ar2) is supplied. Namely, by introducing the second air flow Ar2, the flying speed of the cleaning media 5 may be increased approximately threefold.

As the slice-shaped cleaning media 5, in this embodiment, a triacetate (TAP) film having a thickness of 0.1 mm, pencil hardness of "H", and a folding strength of 24 was used. As described in Patent Document 3, by using the cleaning media having the folding strength equal to or less than 45, the cleaning media may maintain the sufficient thickness and form new edges even when being broken. Therefore, the ability of chipping the stains may not be (remarkably) degraded even when the cleaning media is continuously used.

Figure 4:
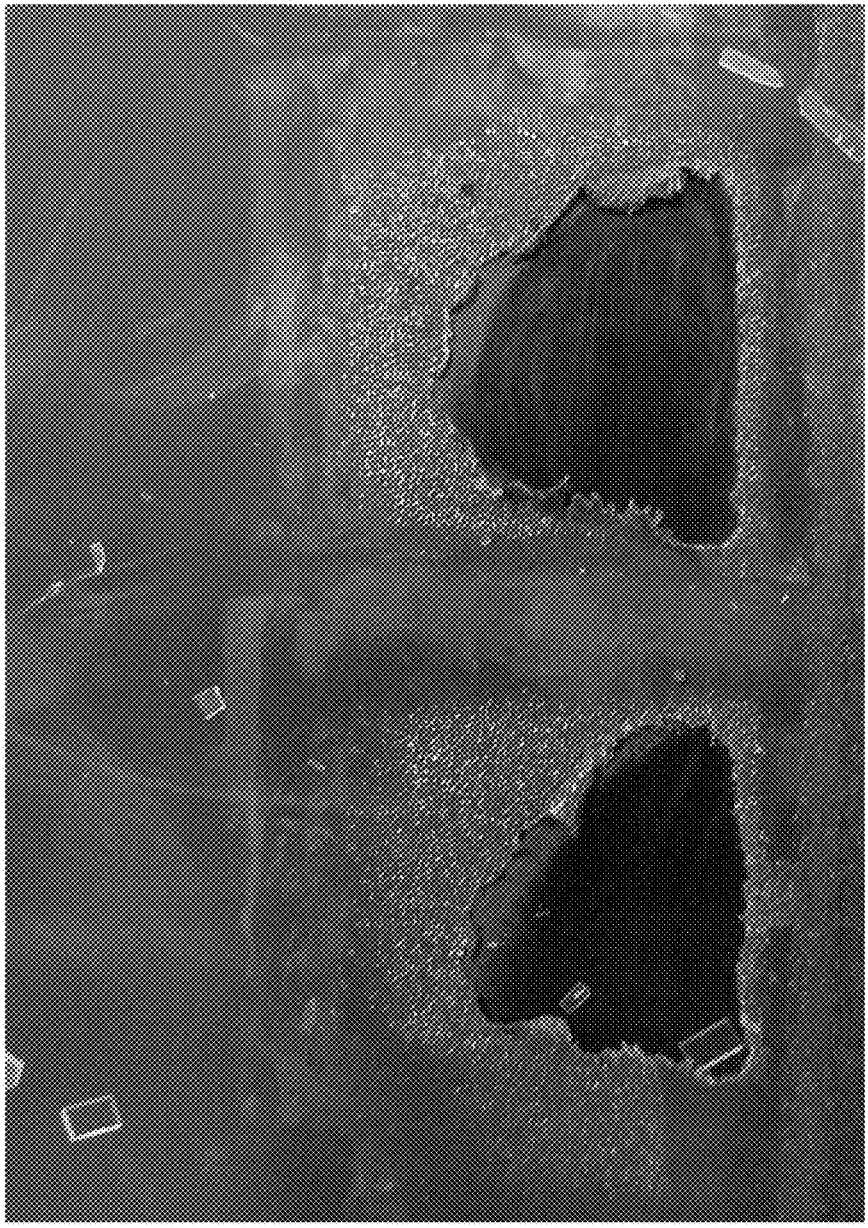
FIG. 4 is a picture image illustrating a cleaning performance.
Figure 5:
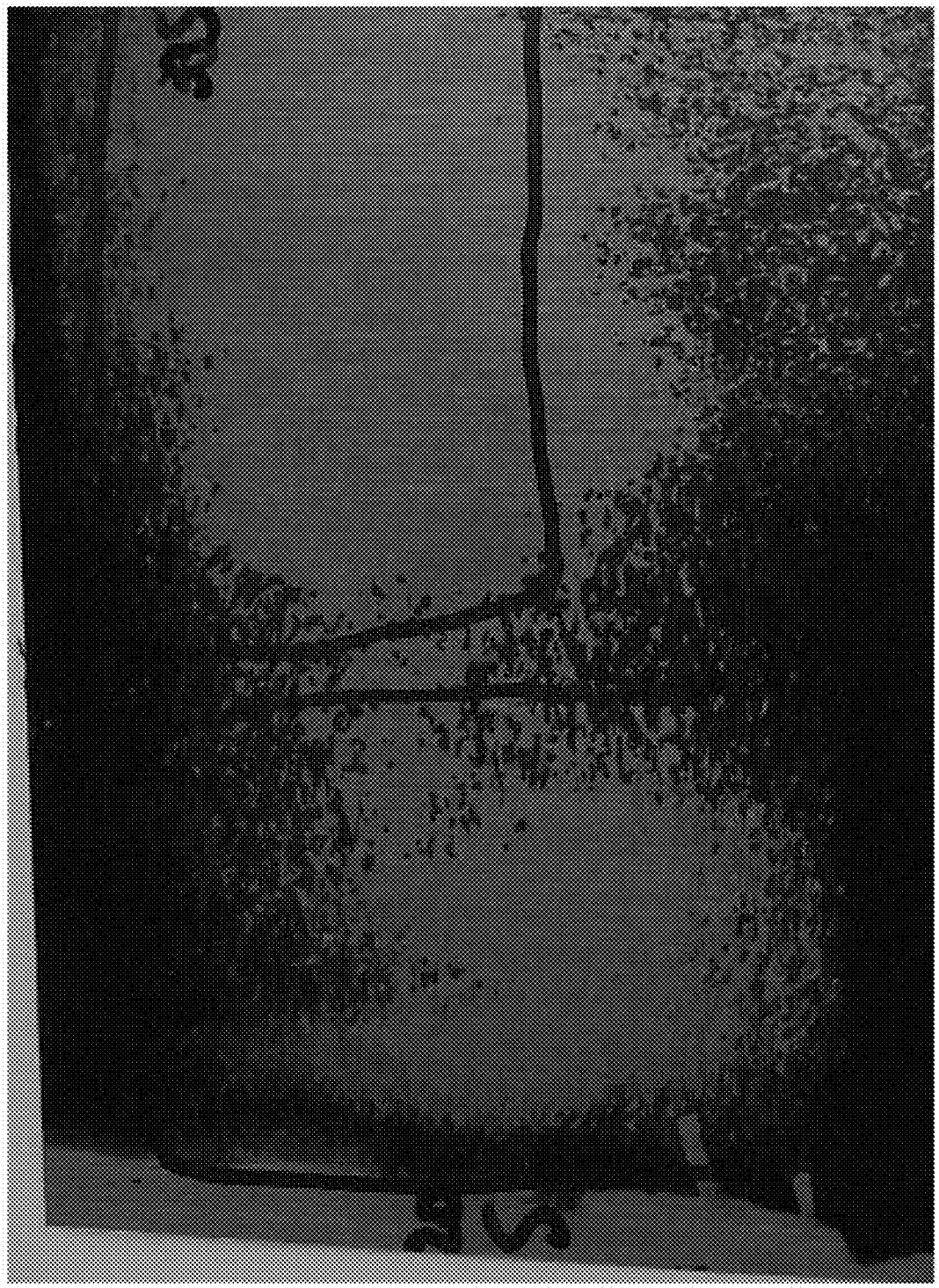
FIG. 5 is another picture image illustrating the cleaning performance.
Figure 6:
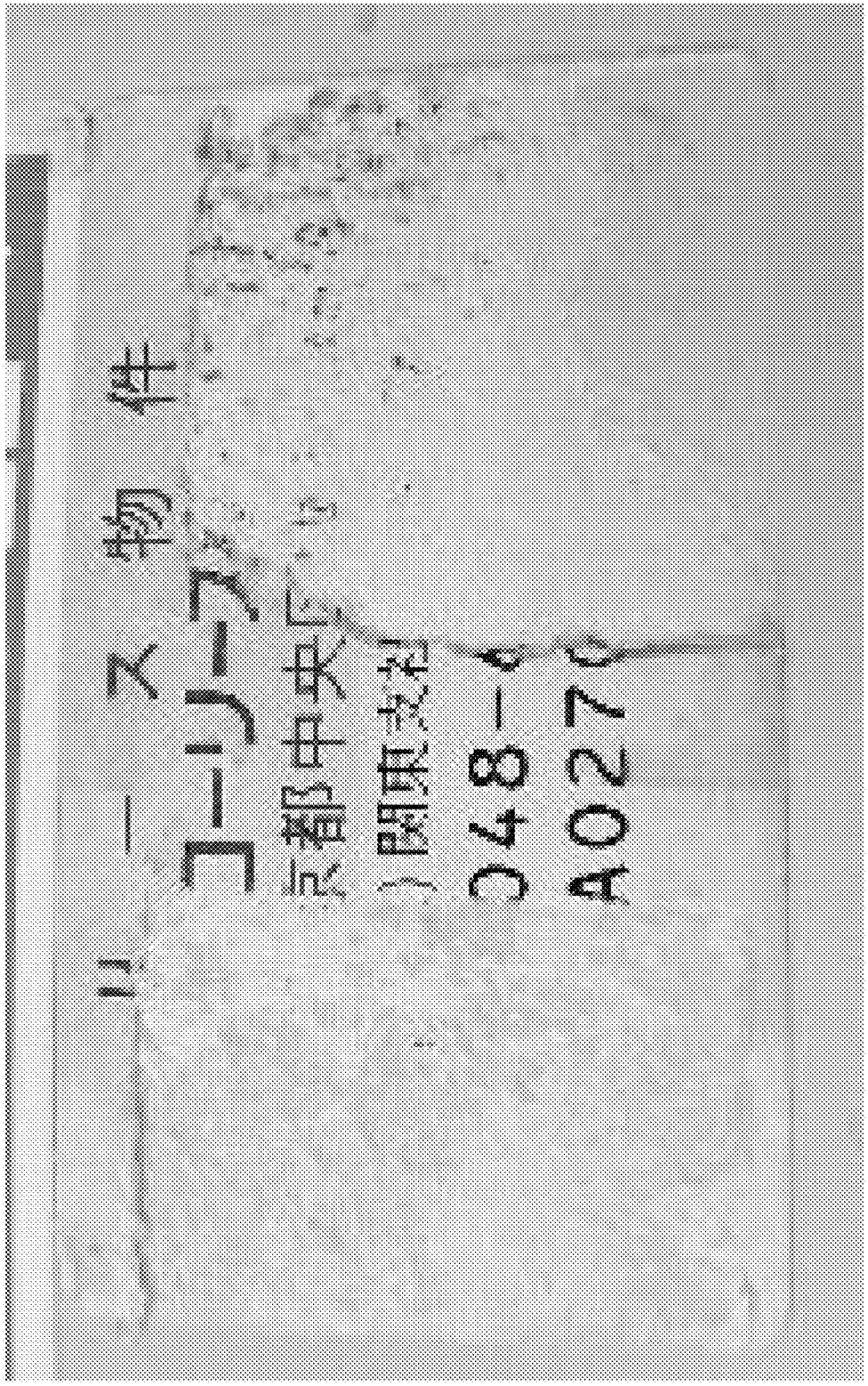
FIG. 6 is another picture image illustrating the cleaning performance.
Figure 7:
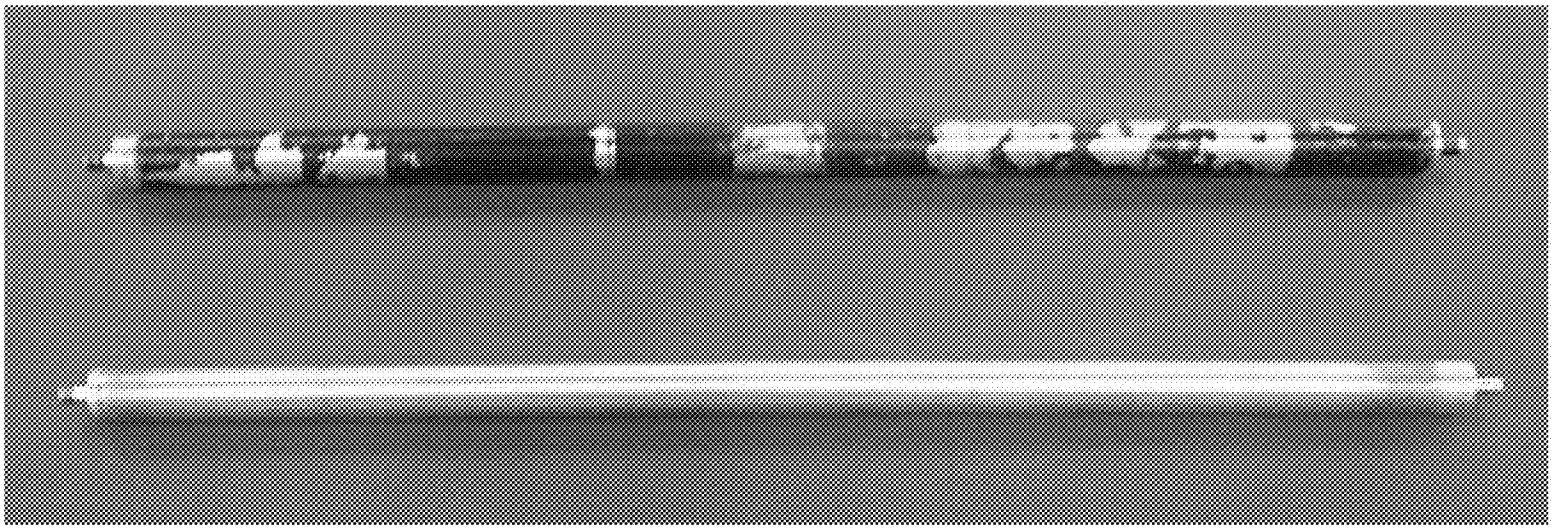
FIG. 7 is another picture image illustrating the cleaning performance.

FIGS. 4 through 7 are picture images illustrating improved cleaning performances according to this embodiment by introducing the second air flow Ar2. Specifically, FIGS. 4 through 6 illustrates cases where the stains (cleaning targets) having viscoelasticity not having been removed with a conventional device have been removed. FIG. 7 illustrates a case where the cleaning time period is reduced.

FIG. 4 schematically illustrates a case where a polyimide belt having a rubber film (as a stain) coated thereon was tested as the cleaning target.

The stain (rubber film) was not removed by the first air flow alone, but was removed and the base (belt) was exposed in approximately twenty seconds when the second air flow was (additionally) introduced.

FIG. 5 illustrates a case where a metal part having a coated film was tested as the cleaning target.

The stain (coated film) was not removed by the first air flow alone, but was removed in approximately twenty to thirty seconds when the second air flow was (additionally) introduced.

FIG. 6 illustrates a case where a paper-based seal adhered to the outer cover of a copier made of ABS resin was tested as the cleaning target.

The stain (paper decal) was not removed by the first air flow alone, but one of the paper decal (a contacting part of the opening part) was separated in approximately twenty seconds when the second air flow was (additionally) introduced.

FIG. 7 illustrates a case where fixed toner having a thickness of approximately 1 mm thermally adhered to a metal cleaning roller having a length of 30 mm was tested as the cleaning target. The upper part of FIG. 7 illustrates an initial state.

In a conventional method using only the first air flow, it took approximately thirty minutes to remove most of the stain (fixed toner). Namely the stain (fixed toner) was not completely removed and partially remained.

As illustrated in the lower part of FIG. 7, when the second air flow was also introduced, the stain (fixed toner) was removed from the entire surface of the roller in approximately ten minutes.

Table 1 illustrates the cleaning results depending on the conditions of the first and the second air flows. In Table 1, symbol marks are used to indicate the evaluation results. Specifically, the symbol "○" denotes that stains (foreign matter) may be cleaned (removed). The symbol "◎" denotes that the that stains (foreign matter) may be cleaned in a shorter time period than the case of "○". On the other hand, the symbol "Δ" denotes the cleaning ability may be observed but the removing speed of removing the stains may be impractically slow. The symbol "x" denotes that no cleaning ability was observed.

TABLE 1

| | FLOW CONDITIONS [FLOW SPEED (FLOW RATE)] | | STAINS TO BE REMOVED | |
|---|---|---|---|---|
| | FIRST AIR FLOW | SECOND AIR FLOW | FIXED FLUX | STAINS HAVING VISCO-ELASTICITY |
| (1) | 113 m/s (650 l/min) | 250 m/s (300 l/min) | ◎ | ○ |
| (2) | 113 m/s (950 l/min) | 0 m/s (0 l/min) | ○ | X |
| (3) | 0 m/s (0 l/min) | 250 m/s (300 l/min) | ○ | Δ |

In table 1, the condition (2) denotes that only the first air flow was used but the compression air supply tube 52 was removed from the inlet 24. As a result, the flow speed was substantially constant, but the flow rate was increased.

On the other hand, the condition (3) denotes that only the second air flow was used. To that end, an aluminum tape was used to completely seal the inlets other than the inlets connected to the compression air supply tube, so as to reduce the first air flow to be introduced due to the negative pressure generated in the chassis to zero. Then the device was driven.

As a result, in the case where both the first and the second air flows are used, fixed flux was removed faster than any other cases. Further, the stain having viscoelasticity that was not sufficiently removed when only one of the first air flow and the second air flow used was sufficiently removed.

When the configuration in this embodiment compared with the configuration where only the compression air the second air flow Art) is used to generate the circulating aerial flow 30 without suctioning the air. When the circulating flow 30 is generated by the compression air alone to fly the cleaning media 5, a positive pressure is more likely to be generated in the chassis 4. As a result, the slice-shaped cleaning media 5 may be more likely to leak from the boundary of the opening part 18.

On the other hand, according to the embodiment, due to the suctioning, a negative pressure may be maintained. Therefore, the cleaning media 5 are unlikely to leak. Further, when only the air flow of the compression air is supplied (injected) into the chassis 4, the flow speed of the injected air may be generally increased by squeezing the diameter (gauge) of the injection out port. However, accordingly, the flow rate may be reduced. When the flow rate is reduced, the energy of the air flow may be promptly attenuated. Namely, it may not be possible to generate a strong circulating air flow in the circulating aerial flow 30 having a much larger flow path (cross-sectional) area than the diameter (gauge) of the injection out port of the compression air.

However, as described above, by introducing external air through the inlet 24 by the negative pressure due to the suction force, so that, even when the flow speed of the air injected through the air flow injection port 24B is relatively slow, by injecting the air flow having a larger flow rate, a strong circulating air flow may be generated.

The cleaning media 5 fed by the strong circulating air flow may be accelerated by the fast air flow, so as to collide with the cleaning target at a fast speed and remove the stains (foreign matter) with sufficient force.

Figure 3:
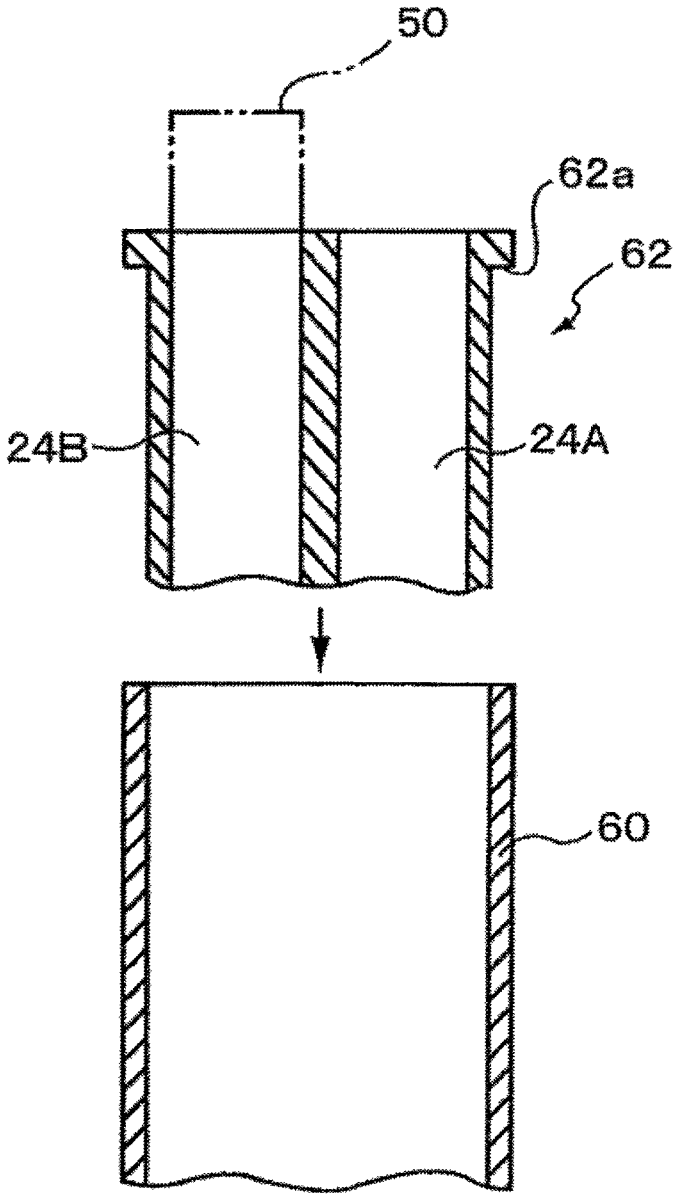
FIG. 3 is a schematic cross-sectional view illustrating a detachable structure of an inlet in an attachment mechanism.

In this embodiment, a case is described where the nozzle 50 is inserted into the air flow injection port 24B of the inlet 24 fixed to the chassis 4. However, for example, as schematically illustrated in FIG. 3, the inlet opening 24A and the air flow injection port 24B may be integrally formed to be an attachment 62 that is detachably connected with (inserted into) an inlet frame 60 fixed to the chassis 4. The attachment 62 includes a flange-shaped stopper 62*a*, so that the position of the attachment 62 relative to the inlet frame 60 may be fixed by simply inserting the attachment 62 into the inlet frame 60. Further, by preparing plural types of the attachments 62 having different inserting diameters of the air flow injection ports 240, inserting the plural types of the nozzles 50 having the corresponding injection diameters (gauges), and selecting and using the appropriate air flow injection port 240 and the nozzle 50, it may become possible to optimize the cleaning ability.

Further, as illustrated in the dashed two dotted line in FIG. 3, the attachment 62 with the nozzle 50 fixed to the attachment 62 may be formed. Further, the air flow injection ports 24 may be formed as the nozzle having the connection port to connect the compression air supply tube 52.

Further, the attachment 62 having no air flow injection ports 24B may be provided so as to make it easier to switch between the state where the compression air is used and the state where no compression air is used.

In the above embodiment, a case is described where the valve 56 is provided to select one of two steps which are to open and close the supply of the compression air. Alternatively, the valve 56 may include a now rate adjuster, so the compression air injection amount may be adjusted in plural steps (levels to adjust the cleaning ability or a damage to the cleaning target body. The flow rate adjustment by the valve means the adjustment of the injection flow speed by the nozzle 50.

As described above, the flow rate of the compression air may be required to be equal to or less than the suction amount of the air suctioned by the suction device 12. If air having the flow rate exceeding the suction amount is introduced into the chassis 4, the suction device 12 may not sufficiently suction the air and the pressure in the chassis 4 may become an atmospheric pressure or a positive pressure. Namely, the negative pressure in the chassis 4 may not be maintained. If the pressure in the chassis 4 is a positive pressure, the adsorption force of the chassis 4 may be reduced; and therefore it may become difficult to stick the opening part 18 to the cleaning target 20.

Further, the positive pressure is generated in the chassis 4, a force to push out the contents between the opening part 18 and the cleaning target 20 may be generated. In this case, the cleaning media 5 are more likely to enter between the opening part 18 and the cleaning target 20, so that the slice-shaped cleaning media 5 may narrow (clog) the opening part 18 like a wedge and finally cover the opening part 18. This is not preferable because cleaning is prevented and the leakage of the cleaning media 5 may occur.

The suction amount is determined based on the suction force of the suction device 12 and the pressure loss of the separation plate 14.

Further, it is desirable that the flow speed near the injection port by the compression air be faster than the speed of the circulating aerial flow 30 generated by the suctioning. This is because, if the flow speed is equal to or slower than the speed of the circulating aerial flow 30, the flying speed of the cleaning media 5 may not be accelerated.

Next, a second embodiment is described with reference to FIGS. 8 and 9.

In this embodiment, the air flow injection port is disposed at a position different from the position of the inlet 24.

As described above, in a fundamental configuration of the present invention, the circulating aerial flow 30 is generated in the chassis 4 and the cleaning media 5 are flown by the "air flow having a large flow rate but having a relatively slow flow speed" supplied from the inlet 24.

The acceleration of the cleaning media 5 is made by the compression air injected from the nozzle of the air flow injection port. From this point of view, it is not always necessary for the inlet 24 to be directed toward the opening part 18.

Therefore, in this embodiment, the air flow direction through the inlet 24 dedicated to introduce external air is set to be substantially orthogonal to the surface of the cleaning target 20, and the air flow injection port 64 serving as the nozzle as well is disposed at a position different from the position of the inlet 24 on the outer periphery surface of the chassis 4, so that the air flow from the air flow injection port 64 is directed to the opening part 18.

The flying media 5 flown by the circulating aerial flow 30 are accelerated by a fast compression air flow injected from the air flow injection port 64 toward the opening part 18, passed through the opening part 18, and collide with the cleaning target 20 at a high speed, so as to remove the foreign matter (including stains having viscoelasticity) adhered to or fixed to the surface of the cleaning target 20.

Figure 8:
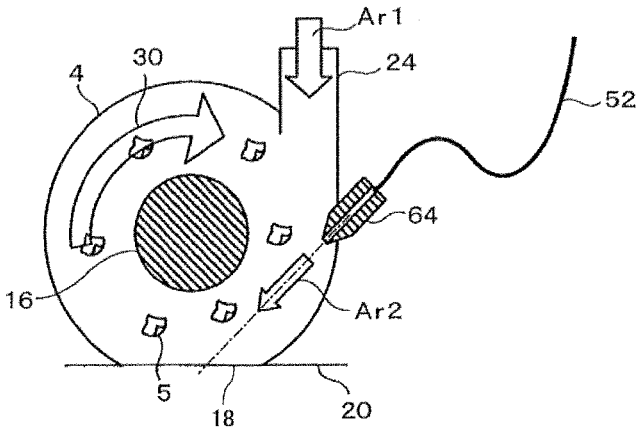
FIG. 8 is a schematic cross-sectional view of the dry-type cleaning chassis according to a second embodiment.

FIG. 8 illustrates a case where the air flow injection port 64 is disposed on the outer periphery surface of the chassis 4. However, the position of the air flow injection port 64 is not limited to this position. Namely, the air flow injection port 64 may be disposed at any appropriate position as long as the cleaning media 5 flown by the circulating aerial flow 30 tray be accelerated towards the opening part 18.

Figure 9:
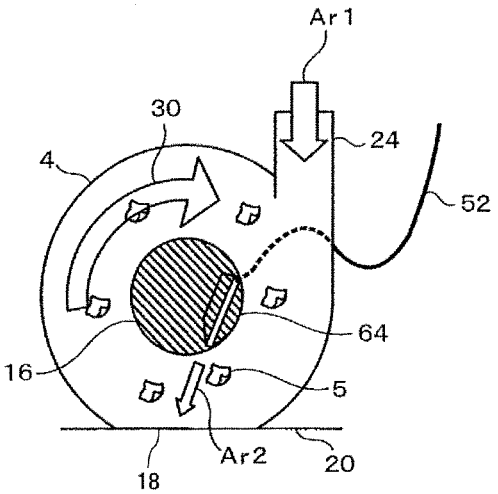
FIG. 9 is a schematic cross-sectional view of the dry-type cleaning chassis according a modified example.

For example, as illustrated in FIG. 9, if the air flow injection port 64 is disposed inside the flow path limiting member 16 so as to inject the compression air toward the opening part 18, it may also be possible to assist the acceleration of the cleaning media 5.

Next, a third embodiment is described with reference to FIGS. 10A through 11.

In the above embodiment, it is necessary to manually open and close the valve 56 by an operator. However, when the cleaning operation is finished, if the operator does not close the valve 56 before separating the opening part 18 from the cleaning target 20, due to the continuous supply of the compression air from the air flow injection port, the adsorption of the cleaning media 5 to the separation plate 14 by the suction device 12 may be impeded and the cleaning media 5 may be scattered outside the chassis 4 through the opening part 18.

This problem may be overcome by this embodiment. Namely, as illustrated in FIG. 10A, there is provided a thick-walled part 4A-3 having a rectangular shape disposed circumference of the opening part 18 on the outer periphery surface of the chassis 4.

Further, there is provided a packing 66 made of rubber and fixed to the whole circumference of the lower surface of the thick-walled part 4A-3. The lower surface of the thick-walled part 4A-3 serves as a sealing member having a hollow part and having a large deformation amount and a flexible member.

Further, there is at least one contact sensor 68 disposed on the lower surface of the thick-walled part 4A-3 and in the packing 66. When contact sensor 68 is pressed, a current flows through the contact sensor 68.

The contact sensor 68 is connected to a controller 72 that controls the an electromagnetic valve 70 disposed in place of the manual valve 56 between the air flow injection port and the compressor 54 which is a compression air supply source.

Figure 10A:
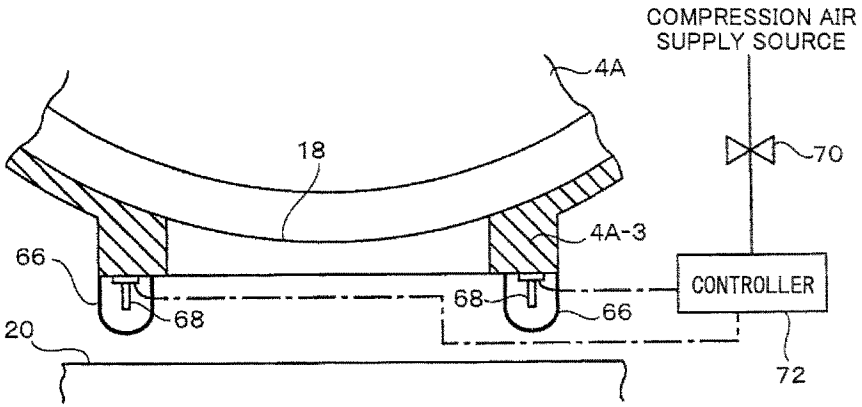
FIGS. 10A and 10B are schematic cross-sectional views of a main part of the dry-type cleaning chassis according to a third embodiment.

As illustrated in FIG. 10A, when the packing 66 is separated from the cleaning target 20 or when the packing 66 is in slight contact with the surface of the cleaning target 20, the contact sensor 68 is in an OFF state, so that the electromagnetic valve 70 is closed.

Figure 10B:
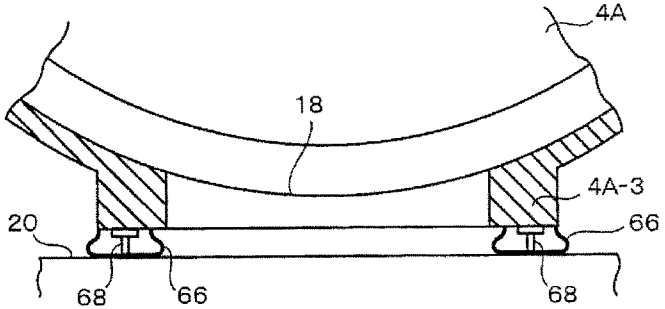

On the other hand, as illustrated in FIG. 10B, when the opening part 18 is pressed to the cleaning target 20, the packing 66 is deformed so that air sealing provided between the surface of the cleaning target 20 and the opening part 18 and a preferable condition for cleaning is provided.

Due to the deformation of the packing 66, the contact sensor 68 is set to an ON state so that the electromagnetic valve 70 is open by the controller 72. Further, when the packing 66 is in slight contact with the surface of the cleaning target 20, a negative pressure may be generated by the suction device 12. Therefore, the circulating aerial flow 30 may be generated before the contact sensor 68 is set to the ON state.

Namely, slightly after the generation of the circulating aerial flow 30, the contact sensor 68 is turned ON slightly after the generation of the circulating aerial flow 30 and the compression air (i.e., the second air flow Ar2 is injected. By doing this, it may become possible to prevent the useless injection of the compression aerial flow before the cleaning media 5 starts flying by the circulating aerial flow 30.

Contrary to the above, when the cleaning operation is finished and the opening part 18 is separated from the cleaning target 20, the contact sensor 68 is set to the OFF state to stop the injection of the compression aerial flow before the air sealing between the surface of the cleaning target 20 and the opening part 18 is completely released.

Therefore, it may become possible to prevent the leak of the cleaning media 5 to the outside of the chassis by the compression aerial flow when the opening part 18 is separated from the cleaning target 20.

As described above, by automatically open and close the injection of the compression aerial flow, an operation error of the valve may be fundamentally prevented.

In this embodiment, more specifically, four contact sensors 68 are disposed at the respective four sides of the opening part 18 having a rectangular shape. Further, only when all of the four contact sensors 68 are turned ON, the electromagnetic valve 70 is controlled to be open and the compression air is supplied.

By doing this, it may become possible to accurately avoid the leak of the cleaning media 5 due to the injected compression aerial flow when the air sealing is provided only partially due to inappropriate holding of the chassis.

According to this embodiment, it may become possible to achieve the sealing function of the opening part 18 relative to the cleaning target 20 and the optimized control of turning ON and OFF the injection of the compression aerial flow at the same time.

Figure 11:
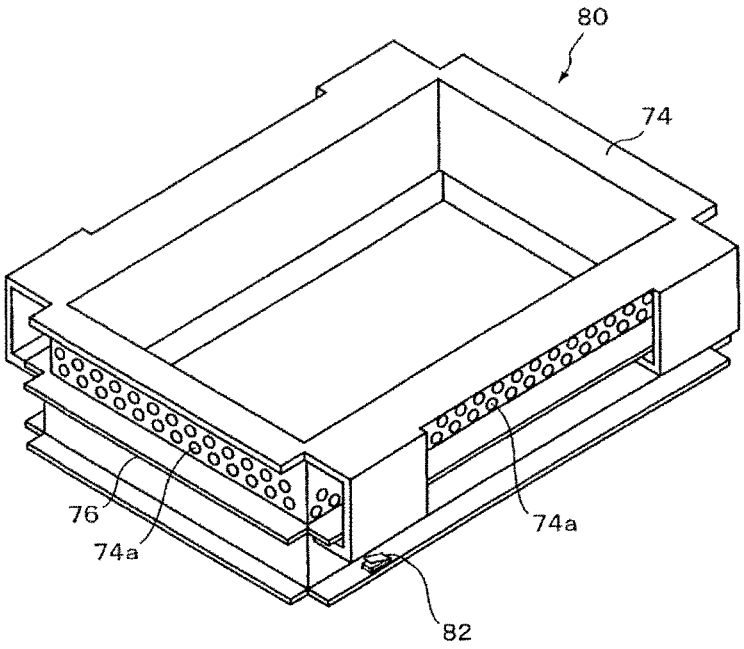
FIG. 11 is a schematic perspective view of the dry-type cleaning chassis according to a modified example.

FIG. 11 illustrates another configuration to prevent the leak of the cleaning media 5.

Specifically, FIG. 11 illustrates a cleaning medium leak prevention unit 80 to be disposed on the lower surface of the opening part 18. The cleaning medium leak prevention unit 80 serves as a movable member and includes a fixing tube 74 to be fixed to the thick-wailed part 4A-3 and a movable tube 76.

Between the fixing tube 74 and the movable tube 76, a biasing member (not shown) is provided, so that the movable tube 76 protrudes downward due to the biasing force by the biasing member when no external force is applied to the cleaning medium leak prevention unit 80. On side surfaces of the fixing tube 74, there are formed many external air introducing holes 74*a*. When the lower surface (end surface) of the movable tube 76 is pressed to the cleaning target 20 and the cleaning medium leak prevention unit 80 is pressed, the fixing tube 74 is (relatively) moved into the movable tube 76 and the external air introducing holes 74*a* are sealed, so as to become a state that opening part 18 is sealed. The size of the external air introducing holes 74*a* is determined so as not to pass (leak) the cleaning media 5.

Further, a micro switch 82 is provided on a fringe (edge) of the lower end of the movable tube 76. When the cleaning medium leak prevention unit 80 is pressed (and the micro switch 82 is pressed), the micro switch 82 is turned on to inject the compression aerial flow.

When the cleaning operation is finished and the chassis 4 is moved, the fixing tube 74 is moved from the movable tube 76 and the micro switch 82 is turned off so as to stop the injection of the compression aerial flow.

In this embodiment, as the fixing tube 74 is moved from the movable tube 76, external air is introduced into the inside of the opening part 18 through the external air introducing holes 74*a*. As a result, the cleaning media 5 disposed near the opening part 18 and "less subject to the influence of the suction force by the negative pressure" may be pushed inside chassis 4. Therefore, it may become possible to further improve the prevention of the leak of the cleaning media 5 from the opening part 18.

Preferable, a soft material is used on the lower surface of the movable tube 76 to improve the sealing function.

Next, a fourth embodiment is described with reference to FIG. 12.

When, due to various causes such as unexpected drop of the suction force of the suction device 12, the suction force is reduced and the negative pressure is lowered so that a negative pressure in the chassis 4 is not sufficient to prevent the leak of the cleaning media 5. As a result, the cleaning media 5 may leak due to the influence of the second air flow.

This embodiment may overcome the problem.

Figure 12:
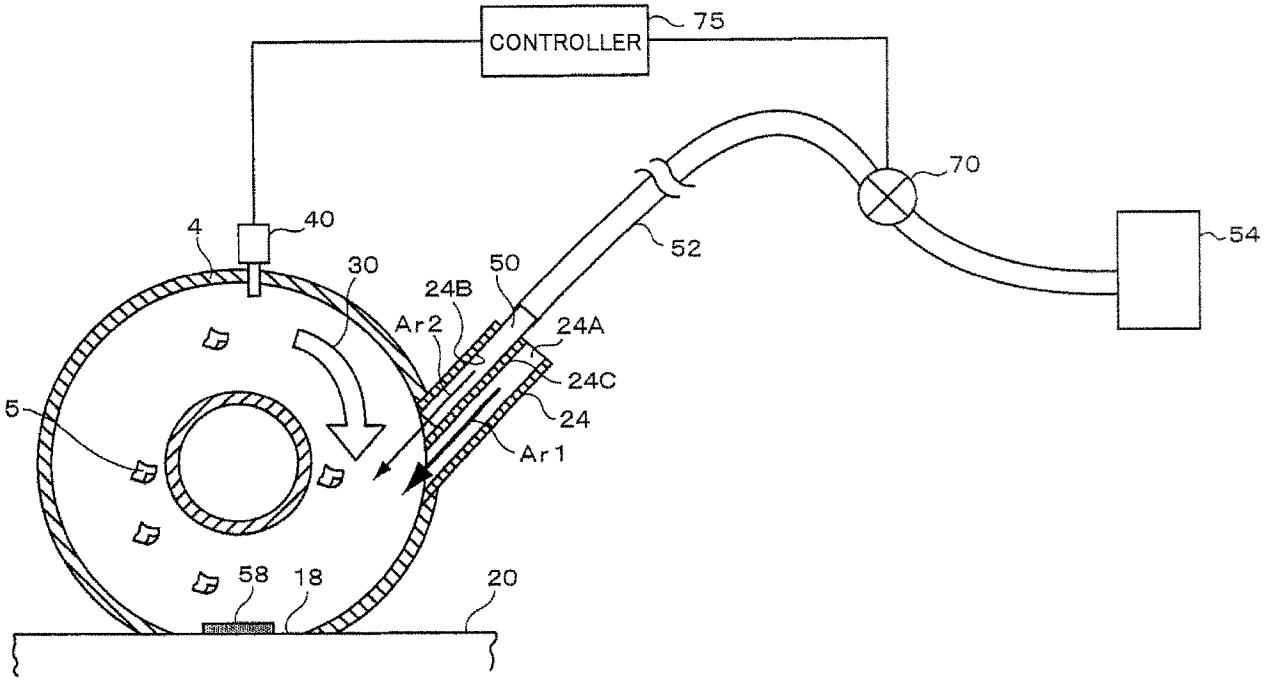
FIG. 12 is a side view of a dry-type cleaning chassis when being used according to a fourth embodiment.

As illustrated in FIG. 12, the chassis includes a fine differential pressure sensor 40 as a pressure detector detecting the pressure in the chassis 4. Further, the electromagnetic valve 70 as the flow rate adjuster is disposed between the nozzle 50 and the compressor 54. Both of the fine differential pressure sensor 40 and the electromagnetic valve 70 are connected to a controller 75.

The fine differential pressure sensor 40 converts the difference between the atmospheric pressure and the pressure in the chassis 4 into current value, and outputs the current value to the controller 75. The controller 75 monitors the current value. When determining that the current value becomes lower than a predetermined threshold value and approaches zero, the controller 75 controls the electromagnetic valve 70 to squeeze the flow amount of the compression air (second air flow). By doing the feedback control, it may become possible to maintain the negative pressure with less than a predetermined value in the chassis 4.

By monitoring the negative pressure in the chassis 4 using the sensor, if suction force is reduced and the negative pressure necessary to prevent the leak of the cleaning media 5, it may become possible to stop the injection air (second air flow) or reduce the supply amount of the injection air. By doing this, it may become possible to more reliably prevent the leak of the cleaning media 5.

Figure 13B:
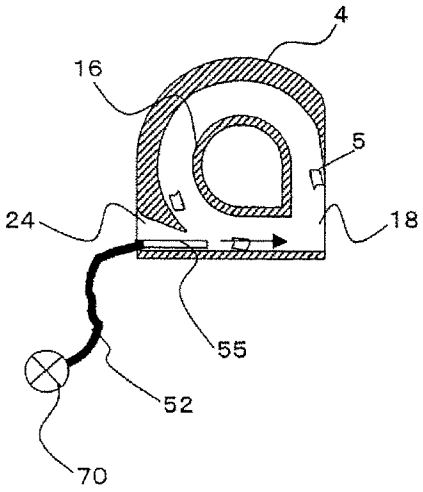
FIG. 13B is a cross-sectional view cut along a line C-C' in FIG. 13A.
Figure 13A:
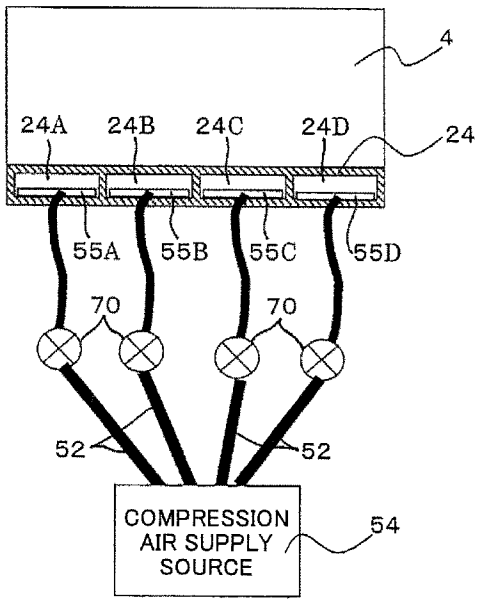
FIG. 13A is a view of the dry-type cleaning chassis when externally viewed from an inlet side according to a fifth embodiment.

Next, a fifth embodiment is described with reference to FIGS. 13A and 13B.

In this embodiment, similar to the configuration of FIG. 2, the suction port generating the first air flow and the suction port generating the second air flow are integrally formed in the inlet 24.

The air flow injection ports generating the second air flow include four injection nozzles 55A through 55D connected to the compressor (compression air supply source) 54 via urethane tubes 52. The injection nozzles 55A through 55D are fixed inside the inlet openings 24A through 24D, respectively. Further, the electromagnetic valves 70 to be independently controlled to open and close are provided between the corresponding injection nozzles 55A through 55D and the compression air supply source 54. The electromagnetic valves 70 are connected to a controller (not shown), so that the electromagnetic valves 70 are independently controlled to open and close.

By using the configuration, when one of the injection nozzles is stopped and the other three of the injection nozzles are driven, the injection nozzle to be stopped is periodically switched from one to another.

By doing this, in the region where the injection is stopped, the air flow speed in the chassis may be reduced. Namely, in this region, the cleaning media 5 are less likely to move when compared with the other regions where compression air is injected. As a result, the cleaning media flying in the regions where the air flow speed is higher may be attracted and collected to the region where the air flow speed is lower.

By periodically changing the nozzle from which the injection is stopped, the region where the cleaning media are collected may vary in accordance with the change of the nozzles. By using this phenomenon, even when the chassis has a long shape, it may become possible to prevent the retention of the cleaning media in a specific region and the occurrence of uneven cleaning.

Namely, by changing the regions where the injection air flow is applied, it may become possible to dissipate the cleaning media and avoid the biased distribution of the cleaning media and accordingly uneven cleaning quality. This configuration may be especially effective when the chassis is widened in the direction parallel to the direction of the circulating air flow axis.

Figure 14:
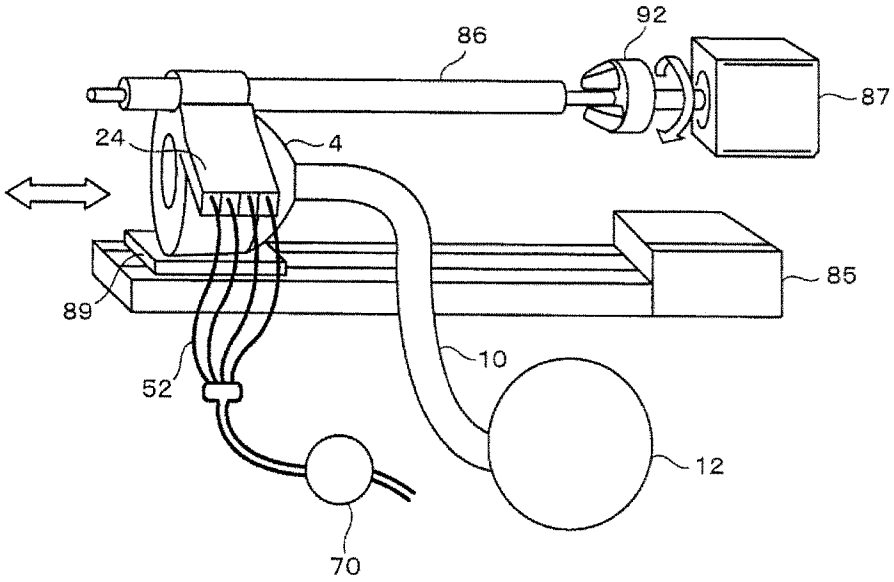
FIG. 14 is a schematic perspective view of a dry-type cleaning system according to a sixth embodiment.
Figure 15:
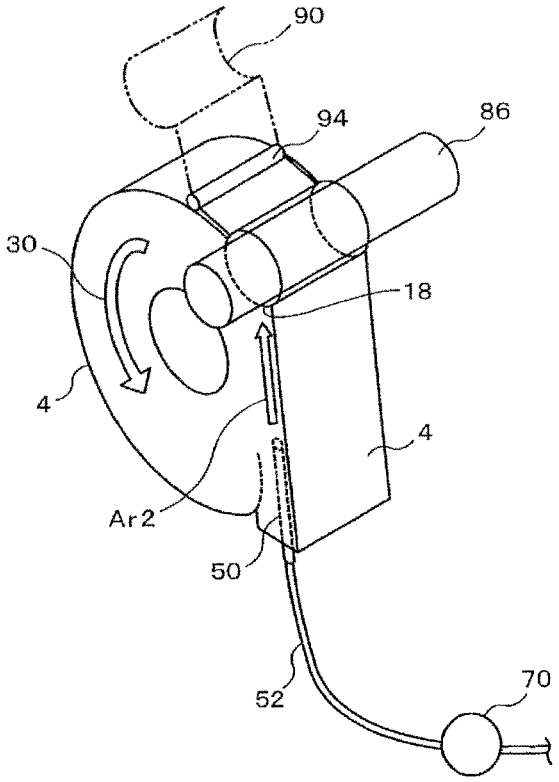
FIG. 15 is a schematic perspective view of a rotation mechanism of a sealing cover of the dry-type cleaning system in FIG. 14.

FIGS. 14 and 15 illustrate a dry-type cleaning system according to a sixth embodiment.

In this embodiment, an example application where a cleaning device for cleaning toner is fixed to a roller. There are many rollers used in an electrical printer. For example, in the fixing unit of the electrical printer, rollers are used to supply heat and pressure so that toner is extremely firmly fixed to the rollers. Therefore, it may be difficult to remove the toner with a conventional cleaning device using slice-shaped cleaning media.

In this embodiment, the toner fixed to the roller may be removed, so that the roller may be used again.

The dry-type cleaning system according to this embodiment includes a linear motor 85, a motor 87, the electromagnetic valve 70, the suction device 12, the dry-type cleaning chassis 4, and the compression air supply source (not shown). The linear motor 35 serves as a cleaning region changer and is driven by a sequencer (not shown). The motor 87 rotates the roller 86 as the cleaning target.

The dry-type cleaning chassis 4 includes the inlet 24 where the air flow injection ports are integrally formed, and supported on a blanket 89 driven by the linear motor 85.

The opening part of the dry-type cleaning chassis 4 is curved so as to fit the shape of the roller 86. Further, a sealing cover 90 is disposed so as to maintain the negative pressure in the dry-type cleaning chassis 4 by covering (sandwiching) the roller 86.

By supplying the cleaning media into the chassis, driving the suction device 12, opening the electromagnetic valve 70, and injecting the compression aerial flow to the opening part, the surface of the roller may be cleaned.

Further, by straightly moving the dry-type cleaning chassis 4 along the direction of the axle of the roller 86, and rotating the roller 86 by the the entire surface of the roller 86 may be cleaned. The reference numeral 92 in FIG. 14 denotes a chuck as a holder.

As illustrated in FIG. 15, the sealing cover 90 is rotatably (openably) provided on a supporting shaft 94 fixed to the outer peripheral surface of the chassis.

In the above embodiments, as the air flow that increases the circulating flying speed of the cleaning media by assisting the first air flow, only the second air flow (compression aerial) is described. However, in addition to the second air flow, any air flow other than the second air flow may also be added to further increase the circulating flying speed of the cleaning media.

The material and the size of the cleaning media 5 may be selected depending on the types of the stains on the cleaning targets 20. Next, examples of appropriate cleaning media 5 for removing film-like mattes such as flux attached to the cleaning targets 20 are described.

Figure 19A:
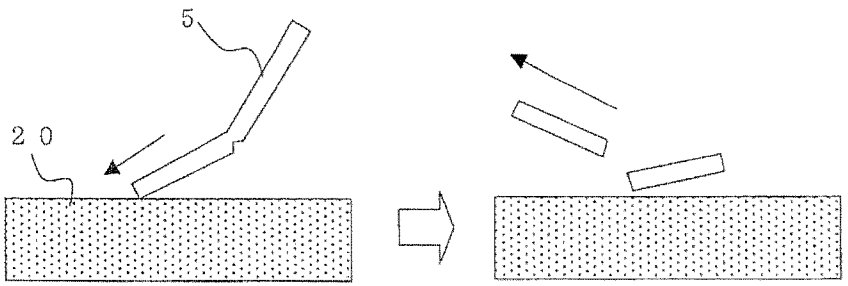
FIGS. 19A through 19D illustrates example collisional patterns of a slice-shaped cleaning medium.
Figure 19B:
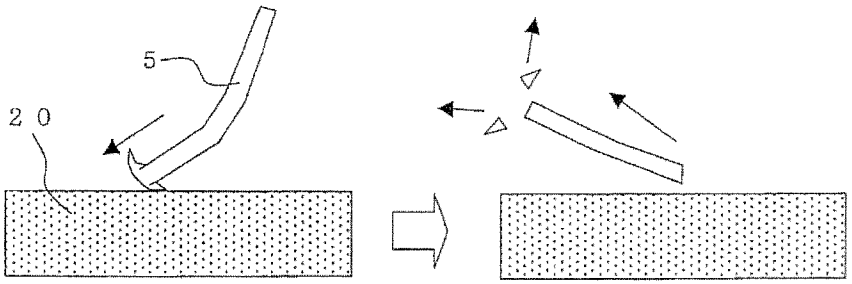
Figure 19C:
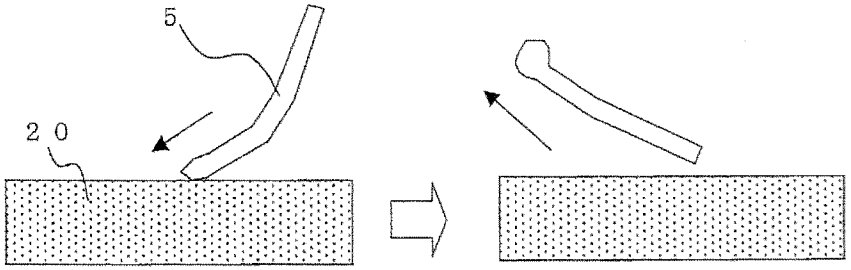

FIGS. 19A through 19D schematically illustrate patterns of the collision of the sliced cleaning media 5. When the cleaning medium 5 is likely to be plastic-deformed (plastically deformed), as illustrated in FIG. 19C, the edge portion of the cleaning medium may be greatly deformed to increase the contacting area and reduce the impact force. As a result, the contacting force at the edge portion of the cleaning medium upon the collision may be dispersed, thereby degrading the cleaning performance. Therefore, the cleaning medium may not sufficiently dig into the matter such as flux, thereby reducing the cleaning efficiency of the cleaning device.

When the cleaning medium 5 is likely to be ductile fractured, as illustrated in FIG. 190, the plastic deformation of the fractured surface of the cleaning medium may progress to increase the contacting area and reduce the impact force. As a result, the contacting force at the edge portion of the cleaning medium 5 upon the collision may be dispersed, thereby degrading the cleaning performance. Therefore, the cleaning medium 5 may not sufficiently dig into the matter such as flux, thereby reducing the cleaning efficiency of the cleaning device.

On the other hand, when the cleaning medium 5 is likely to undergo a brittle fracture, the plastic deformation of the fractured surface of the cleaning medium 5 may progress less. Therefore, the contacting force at the edge portion of the cleaning medium is unlikely to be dispersed.

Further, when the film like matter is attached to the edge portion of the cleaning medium 5, by repeatedly undergoing the brittle fracture, new edge portions repeatedly formed. As a result, the cleaning efficiency not be reduced.

The brittle materials include glass chips, ceramic chips, resin film chips made of, for example, acrylic resin, polystyrene, and polylactic acid, and the like.

On the other hand, when a bending force is repeatedly applied to the cleaning medium 5, the cleaning medium 5 may be fractured. In the present invention, whether the cleaning medium is formed of a brittle material is defined based on the folding strength.

When the cleaning media 5 formed of the brittle material have the folding strength less than 65, the burrs generated by the repeated collisions of the cleaning medium 5 may not remain on the cleaning medium 5 but the cleaning medium 5 may be broken and separated (see FIG. 19B). In this case, since the burrs may not remain on the cleaning medium 5, the edge portions of the cleaning medium may be maintained.

Further, when the cleaning medium 5 formed of the brittle material has the folding strength less than 10, the cleaning medium 5 is likely to be broken at the center of the cleaning medium 5 without generating the burr (see FIG. 19A).

Therefore, the edge portions of the cleaning medium 5 may be maintained. Due to the maintained edge portions of the cleaning medium 5, the cleaning medium 5 may sufficiently dig into the matter such as flux. Therefore, the cleaning performance (adhered film removing performance) of the cleaning media 5 may not be reduced over time.

Herein, the term "sliced shape" of the cleaning media 5 refers to a shape having a thickness from 0.02 mm to 0.2 mm and an area equal to or less than 100 $mm^2$.

The term "pencil hardness" refers to the data measured based on the method defined in Japanese Industrial Standards (JIS) K-5600-5-4. The data correspond to the tip number of the hardest pencil that does not damage and bend the tested (evaluated) cleaning medium 5 having the sliced shape.

Further, the term "folding strength" refers to the data measured based on the method defined in JIS P8115. The data correspond to the number of folding times back and force of the evaluated cleaning media having the slice shape at the angle of 135 degrees and with R=0.38 mm.

EXAMPLE

In this example, a pallet formed of epoxy resin including glass fibers, with flux being adhered on the pallet, is used as a sample of the cleaning target. The pallet is used for masking the areas not to be soldered on a PCB in a soldering process using a flow solder bath. When such a masking fixture is repeatedly used, flux may be thickly accumulated in a film formed on the masking fixture. Therefore, it is necessary to periodically remove the flux from the masking fixture. The typical pencil hardness of the adhered flux is 2B, and the thickness of the film-like flux is in a range from 0.5 mm to 1.0 mm.

As the cleaning device, the dry-type cleaning device including the dry-type cleaning chassis as illustrated in FIG. 1 was used. As the suctioning unit connected to the cleaning device, a device having suction performance of a degree of vacuum 20 kPa was used. A pallet on which flux has been adhered was prepared. The area (45 mm×60 mm) of the opening part was defined as one sample unit. Then, the pallet was cleaned for three seconds. The amount of the cleaning media was 2 g for each chassis. The used cleaning media having the spliced shape and the cleaning results are illustrated in Table 1 below.

In Table 1, the meanings of the following symbols are as follows:

x: hardly removed

Δ: remained partially

○: mostly cleaned

◎: well cleaned

-: cleaning media were dissipated and discharged from cleaning bath

As the data indicating the properties of various types of the cleaning media, the folding strength and the pencil hardness are used as illustrated in Table 2.

According to the results of Table 2, when the pencil hardness of the cleaning media is less than 2B which is the pencil hardness of the flux, flux was hardly removed. This is because, when the cleaning media collide with flux, the cleaning media cannot sufficiently dig into the film-like flux to remove the flux.

As described above, the cleaning media are blown up by the air flow and collide with the cleaning targets repeatedly. Due to the repeated collision, damage may be accumulated in the cleaning media. As a result, the cleaning media may be degraded by being fractured or deformed.

Figure 20:
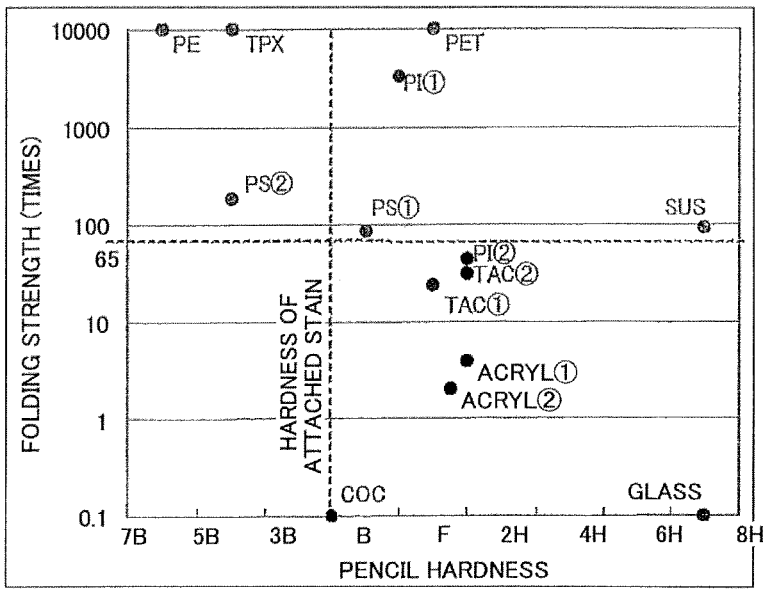
FIG. 20 is a drawing illustrating a distribution of mechanical properties of various types of cleaning media.

Further, FIG. 20 illustrates the mechanical properties (i.e., the folding strength and the pencil hardness) of the various types of the cleaning media.

In the following, the degradation patterns of the cleaning media are described more specifically with reference to Table 2 and FIG. 19. In cases of glass, acryl <1>, acryl <2>, and COC (polyolefin) which are the cleaning media having the folding strength less than 10, as illustrated in FIG. 19A, the cleaning media are broken at the center of the cleaning media due to the impact of the collisions. In this case, however, the broken surfaces become new edge portions of the cleaning media. Therefore, the cleaning performance may not be reduced.

In the cases of TAC (triacetate)<1>, TAC <2>, and PI (polyimide) <2> which are the cleaning media having the folding strength equal to or greater than 10 and less than 65, as illustrated in FIG. 19B, the cleaning media may not be broken at the center of the cleaning media but burrs are generated at the edge portions of the cleaning media due to the impact of the collisions. Then, only the portions of the burrs are broken. Therefore, the thickness of the cleaning media may be maintained, thereby maintaining the capability of removing flux (stains).

In a case where the folding strength of the material of the cleaning media is equal to or greater than 65, the cleaning media may not be broken by the collision but the edge portions of the cleaning media may be plastic deformed.

FIG. 19C illustrates a case where the edge portion is plastic deformed and crushed, so that the end part comes to have a drop shape. This behavior is observed in PI <1>.

Figure 19D:
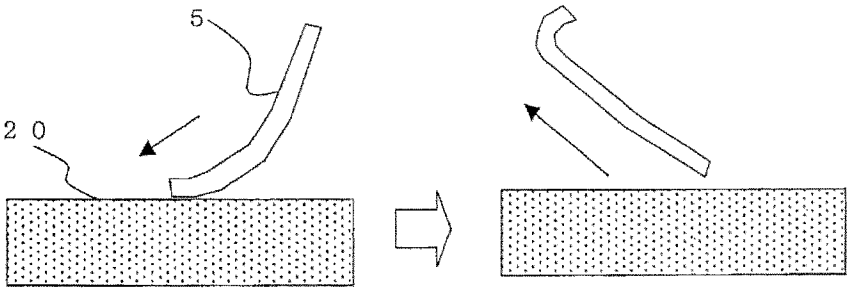

FIG. 19D illustrates a case where the edge portion is plastic deformed and curled. This behavior is observed in SUS, PS <1>, PS <2>, PE, PET, TPX.

The cleaning media have the behaviors as illustrated in FIGS. 19C and 19D, due to the plastic deformation of the edge portions, the edge portions coming to have a drop shape. As a result, the impact force upon the collision may be reduced. Therefore, as illustrated in Table 1, after the collisions of the cleaning media with multiple samples, the cleaning performance were greatly reduced.

Based on the results described above, to remove the adhered flux having accumulated in a film form, when the cleaning media having the pencil hardness equal to or greater than the pencil ha of the flux and formed of a brittle material having the folding strength equal to or greater than 0 and less than 65 is used, desirable results may be stably obtained for a long time period.

As the bases of the figures used in this embodiment, Tables 2 and 3 illustrate ranges of the folding strength of the various types of the cleaning media.

As illustrated in Tables 2 and 3, the cleaning media having the sliced shape in which the average value or the minimum value of the folding strength is zero (herein e.g., glass, COC, and acryl <2>) are formed of a material which is very brittle against the folding force, and are apt to be dissipated in a short time period. Therefore, the running cost may be increased.

Further, the maximum folding strength of the PI <2> indicating good cleaning performance is 52.

Therefore, when the folding strength of the cleaning media is in a range from 1 to 52, the cleaning media may maintain good cleaning performance for a longer time period.

Further, among the cleaning media indicating the behavior of being brittle fractured fractured) as illustrated in FIG. 19A, the maximum folding strength was 9 of the cleaning media formed of acryl <1>. Therefore, the cleaning media may be classified into two categories. Namely, the cleaning media indicating the holding strength in a range from 0 to 9 may be brittle fractured as illustrated in FIG. 19A. Further, the cleaning media indicating the holding strength in a range from 10 to 52 may be brittle fractured as illustrated in 19B.

Further, the cleaning media formed of acryl <2> indicating the minimum folding strength is zero are very brittle and could not be used for a long time period as illustrated in Table 1. On the other hand, the cleaning media formed of acryl <1> indicating the minimum folding strength could maintain the cleaning performance for a long time period as illustrated in Table 2.

TABLE 2

| | CLEANING MEDIA | | | | | |
|---|---|---|---|---|---|---|
| | | THICKNESS | FOLDING | PENCIL | NO OF SAMPLES | |
| No. | MATERIAL | (μ) | STRENGTH | HARDNESS | 1 | 30 |
| 1 | POLYOLEFIN | 155 | 0 | B | X | — |
| 2 | GLASS | 100 | 0 | 9H OR MORE | ◎ | — |
| 3 | ACRYL<2> | 125 | 2 | H-F | ○ | — |
| 4 | ACRYL<1> | 125 | 4 | 2H | ○ | ○ |
| 5 | TAC (TRIACETATE) <1> | 120 | 24 | H | ○ | ○ |

TABLE 2-continued

| | CLEANING MEDIA | | | | NO OF SAMPLES | |
|---|---|---|---|---|---|---|
| No. | MATERIAL | THICKNESS (μ) | FOLDING STRENGTH | PENCIL HARDNESS | 1 | 30 |
| 6 | TAC (TRIACETATE) <2> | 105 | 32 | 2H | ○ | ○ |
| 7 | PI (POLYIMIDE) <2> | 135 | 45 | 2H | ○ | ○ |
| 8 | PS (POLYSTYRENE) <1> | 130 | 88 | HB | Δ | X |
| 9 | SUS (STAINLESS) | 20 | 95 | 9H OR MORE | ◎ | X |
| 10 | PS (POLYSTYRENE) <2> | 150 | 190 | 4B | X | X |
| 11 | PI (POLYIMIDE) <1> | 125 | 3250 | F | Δ | X |
| 12 | PE (POLYETHYLENE) | 100 | 10,000 OR MORE | 6B | X | X |
| 13 | TPX | 100 | 10,000 OR MORE | 4B | X | X |
| 14 | PET | 110 | 10,000 OR MORE | H | Δ | X |

NOTES:
Δ, X: CURL IS GENERATED DUE TO PLASTIC DEFORMATION
X: EDGE PORTION HAS DROP SHAPED DUE TO PLASTIC DEFORMATION

TABLE 3

| No. | MATERIAL | AVERAGE FOLDING STRENGTH | MAXIMUM FOLDING STRENGTH | MINIMUM FOLDING STRENGTH |
|---|---|---|---|---|
| 3 | ACRYL<2> | 2 | 8 | 0 |
| 4 | ACRYL<1> | 4 | 9 | 1 |
| 7 | PI(POLYIMIDE)<2> | 45 | 52 | 41 |
| 8 | PS(POLYSTYRENE) <1> | 88 | 115 | 65 |

According to the average values of the folding strength of the various types of the cleaning media, in order to ensure removal of film-like attached matter such as flux, it may be preferable to use the cleaning media having the pencil hardness equal to or greater than the pencil hardness of the film-like attached matter and having the folding strength in a range from 2 to 45.

Patent Document 1: Japanese Laid-open Patent Publication No. 04-83567

Patent Document 2: Japanese Laid-open Patent Publication No. 60-188123

Patent Document 3: Japanese Laid-open Patent Publication No. 2010-279947

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The present application is based on and claims the benefit of priority of Japanese Patent Application Nos. 2011-040605, filed on Feb. 25, 2011, and 2011-226127, filed on Oct. 13, 2011, the entire contents of which are hereby incorporated herein by reference.

The invention claimed is:

1. A dry-type cleaning chassis for cleaning a cleaning target by colliding cleaning media with the cleaning target, the cleaning media being blown by an air flow, the dry-type cleaning chassis comprising:

an internal space to allow the cleaning media to circulate aerially within the internal space;

an opening part to be in contact with the cleaning target so that the cleaning media collide with the cleaning target;

an air inlet duct to introduce external air into the internal space;

a suction port to generate a first air flow by suctioning the introduced external air through the air inlet duct, to cause a circulating air flow in the internal space;

an injection port disposed parallel to the air inlet duct to generate a second air flow in a same direction as that of the first air flow, to increase a speed of the cleaning media flown by the circulating air flow; and a porous unit to pass objects removed from the cleaning target to a suction port side.

2. The dry-type cleaning chassis according to claim 1, wherein a flow rate of the second air flow generated by the injection port is equal to or less than a flow rate maintaining a negative pressure state in the internal space.

3. The dry-type cleaning chassis according to claim 1, wherein the second air flow generated by the injection port is injected in a direction substantially in parallel to a direction of a flying trace of the cleaning media to collide with the cleaning target in the opening part by the circulating air flow.

4. The dry-type cleaning chassis according to claim 1, wherein the injection port is integrally formed with the air inlet duct, and the second air flow is injected in a direction parallel to a direction of the first air flow.

5. The dry-type cleaning chassis according to claim 1, wherein the injection port is integrally formed with the air inlet duct, and the injection port and the air inlet duct are provided as an attachment detachably provided on the dry-type cleaning chassis.

6. The dry-type cleaning chassis according to claim 1, wherein the injection port is provided on an inner peripheral side of the circulating air flow.

7. A dry-type cleaning device comprising:

the dry-type cleaning chassis according to claim 1;

a suctioning unit connected to the suction port;

an injection air supply source connected to the injection port; and the cleaning media.

8. The dry-type cleaning device according to claim 7, further comprising:

an injection air flow rate adjustment unit disposed between the injection air supply source and the injection port and configured to adjust a flow rate of the second air flow.

9. The dry-type cleaning device according to claim 8, further comprising:

an air pressure detection unit configured to detect an air pressure in the dry-type cleaning chassis; and a controller configured to control the injection air flow rate adjustment unit so that the pressure in the dry-type cleaning chassis is equal to or less than a predetermined value.

10. The dry-type cleaning device according to claim 7, further comprising:

a switch configured to be turn on or off based on a pressing force of the dry-type cleaning chassis relative to the cleaning target, wherein, when no pressing force of the dry-type cleaning chassis relative to the cleaning target is applied, the switch is configured to cut a supply of the second air flow from the injection air supply source.

11. The dry-type cleaning device according to claim 10, further comprising:

a variable member provided on the opening part and configured to be deformed or displaced by the pressing force of the dry-type cleaning chassis relative to the cleaning target, wherein the switch is configured to operate in response to the deformation or the displacement of the variable member.

12. The dry-type cleaning device according to claim 7, further comprising:

a plurality of the injection ports; and a controller configured to control the plurality of the injection ports to arbitrarily open and close.

13. A dry-type cleaning system comprising:

the dry-type cleaning device according to claim 7;

a holding unit configured to hold the cleaning target so as to be cleaned; and a cleaning region changing unit configured to cause at least one of the dry-type cleaning device and the holding unit to move to change a cleaning region of the cleaning target.

* * * * *